US012680706B2

(12) United States Patent
Son et al.

(10) Patent No.: US 12,680,706 B2
(45) **Date of Patent: *Jul. 14, 2026**

(54) ION GENERATING DEVICE AND AIR CONDITIONER COMPRISING THE SAME

(71) Applicant: LG ELECTRONICS INC., Seoul (KR)

(72) Inventors: Ilna Son, Seoul (KR); Bongjun Kim, Seoul (KR); Minwoo Jeong, Seoul (KR); Sehyoun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 917 days.

This patent is subject to a terminal disclaimer.

(21) Appl. No.: 17/984,447

(22) Filed: Nov. 10, 2022

(65) Prior Publication Data

US 2023/0151978 A1 May 18, 2023

(30) Foreign Application Priority Data

Nov. 16, 2021 (KR) ..... 10-2021-0158029

(51) Int. Cl.
*F24F 3/16* (2021.01)
*F24F 8/30* (2021.01)

(52) U.S. Cl.
CPC . *F24F 3/16* (2013.01); *F24F 8/30* (2021.01)

(58) Field of Classification Search
CPC ..... F24F 3/16; F24F 8/30; F24F 8/90; F24F 13/32; F24F 8/192; F24F 11/30;
(Continued)

(56) References Cited

U.S. PATENT DOCUMENTS 5,601,636 A 2/1997 Glucksman
2015/0143839 A1* 5/2015 Lee ..... F24F 1/0076 62/426

(Continued)

FOREIGN PATENT DOCUMENTS

CN 108534253 9/2018
KR 10-0762142 10/2007

(Continued)

OTHER PUBLICATIONS

European Search Report issued in Application No. 22207525.1 dated Mar. 30, 2023.

*Primary Examiner* — Xiuyu Tai
(74) *Attorney, Agent, or Firm* — KED & ASSOCIATES

(57) ABSTRACT

Disclosed are an ion generating device and an air conditioner having the same. The air conditioner may include a housing; a blower which causes a flow of air passing through an inner space of the housing; a heat exchanger located in the inner space of the housing; and an ion generating device which is spaced apart from the heat exchanger, and coupled to an inner side of the housing, wherein the ion generating device may include: a hollow body; a fan which is coupled to one side of the body, and causes a flow of air passing through an inside of the body; and an ionizer which is coupled to the other side of the body, and generates ion, wherein the ionizer may include a case hole which is formed in a portion of the ionizer facing the inside of the body, and communicates with the inside of the body.

18 Claims, 30 Drawing Sheets

(58) Field of Classification Search
CPC ..... F24F 1/0038; F24F 2110/50; F24F 3/001; F24F 13/30; F24F 11/65; F24F 1/0076; F24F 8/20; F24F 2110/64; F24F 1/0073; F24F 13/28; F24F 13/082; F24F 1/0057; F24F 8/194; H01T 23/00; H01T 19/04; H01T 19/00; B03C 3/41; B03C 3/12; B03C 3/38; B03C 3/51; B03C 3/47; B03C 3/04; B03C 3/368; B03C 2201/28; B01D 46/785; A61L 2209/111; A61L 2209/134; A61L 9/22; A61L 2209/16
See application file for complete search history.

(56) References Cited

U.S. PATENT DOCUMENTS

| | | | | |
|---|---|---|---|---|
| 2017/0007953 | A1* | 1/2017 | Lee ..... | F24F 1/0073 |
| 2021/0325066 | A1* | 10/2021 | Thomas, Jr. ..... | F24F 9/00 |

FOREIGN PATENT DOCUMENTS

| | | |
|---|---|---|
| KR | 10-2009-0084429 | 8/2009 |
| WO | WO 2006/106594 | 10/2006 |
| WO | WO 2013/035577 | 3/2013 |

* cited by examiner

| | Ion concentration of the bottom surface (EA/cc) |
|---|---|
| CP1 | 430 thousand |
| TP | 550 thousand |
| CP2 | 310 thousand |

| | Ion concentration of the bottom surface (EA/cc) |
|---|---|
| CP3 | 500 thousand |
| TP | 550 thousand |
| CP4 | 490 thousand |

ION GENERATING DEVICE AND AIR CONDITIONER COMPRISING THE SAME

CROSS-REFERENCE TO RELATED APPLICATION

This application claims the priority benefit of Korean Patent Application No. 10-2021-0158029, filed on Nov. 16, 2021, the disclosure of which is incorporated herein by reference in its entirety.

BACKGROUND OF THE INVENTION

1. Field of the Invention

The present disclosure relates to an air conditioner, and more particularly, to an air conditioner having an ion generating device.

2. Description of the Related Art

In general, an air conditioner refers to a device that cools and heats a room through compression, condensation, expansion, and evaporation of a refrigerant. Such an air conditioner can improve room air quality by exchanging outdoor air with room air through a ventilation device. In addition, the ventilation device may increase the temperature of the air supplied to a room by using a high-temperature combustion gas of a gas furnace.

Such an air conditioner may include an ion generating device to remove bacteria or microorganisms living in the ventilation device. For example, the ion generating device generates negative ions or positive ions by applying a pulsed high voltage to a discharge electrode. An electric field formed by a high voltage applied to the discharge electrode accelerates free electrons in the surrounding air, and the accelerated free electrons collide with neutral molecules in the air, such as nitrogen or oxygen, to ionize the neutral molecules. The negative ions or positive ions generated by the ion generating device provide beneficial effects such as deodorization as well as sterilization.

KR 10-0762142 (Patent date: Sep. 20, 2007) discloses an air conditioner that removes bacteria or microorganisms living in the inside of a duct through a sterilization kit. Specifically, the sterilization kit of the above air conditioner removes bacteria or microorganisms present in the air or living in the inside of the duct by spraying a sterilizing solution into the air supplied from the outside to the room.

However, the sterilization kit of the above air conditioner has the inconvenience of having to periodically refill the sterilizing solution. In addition, the sterilizing solution of the sterilization kit is provided to a duct, or the like by being loaded in the airflow of a blower operated for air conditioning in the room. That is, there is a problem in that the sterilization kit can be operated only while the air conditioning operation is being performed, and the propagation of bacteria or microorganisms cannot be prevented while the air conditioning operation is stopped. In other words, if the air conditioner is operated after not operating for a long time, the polluted air or material remaining in the duct is supplied to the room, which may cause discomfort to occupants and may adversely affect the room air.

KR 10-2009-0084429 (Publication date: Aug. 5, 2009) discloses a vehicle air conditioner for having an ion generating device. However, an ion generating device of the above vehicle air conditioner operates only while a blower for vehicle air conditioning is operating, and provides ions to the occupant. That is, similar to the above-mentioned registered patent, the above vehicle air conditioner also has a problem in that it cannot prevent the propagation of bacteria or microorganisms inside the duct in which the ion generating device is installed while the vehicle air conditioning operation is stopped.

SUMMARY OF THE INVENTION

One object of embodiments of the present disclosure is to solve the above and other problems.

Another object of embodiments of the present disclosure is to provide an air conditioner capable of supplying outdoor air by heating or cooling outdoor air.

Another object of embodiments of the present disclosure is to provide an ion generating device that can remove bacteria or microorganisms that grow in an environment inside the air conditioner, that is, in an environment where condensate water can be generated while it is repeatedly exposed to low temperature and high humidity according to changes in temperature and humidity.

Another object of embodiments of the present disclosure is to provide an ion generating device that can be operated continuously for a long time and is easy to maintain, manage and repair.

Another object of embodiments of the present disclosure is to provide an ion generating device that includes a fan and provides ions to a sterilization target space throughout.

Another object of embodiments of the present disclosure is to provide an ion generating device that includes a fan and can be operated while the air conditioning operation is stopped.

Another object of embodiments of the present disclosure is to provide an ion generating device capable of minimizing air flow resistance during an air conditioning operation.

Another object of embodiments of the present disclosure is to provide an ion generating device capable of maximizing the sterilization performance during a sterilization operation.

Another object of embodiments of the present disclosure is to provide a coupling structure and an optimal installation position between a ventilation device and an ion generating device of an air conditioner.

Another object of embodiments of the present disclosure is to provide various examples regarding the shape and number of an ionizer provided in an ion generating device.

In accordance with an aspect of the present disclosure, an air conditioner may include: a housing; a blower which causes a flow of air passing through an inner space of the housing; a heat exchanger located in the inner space of the housing; and an ion generating device which is spaced apart from the heat exchanger, and coupled to an inner side of the housing.

In accordance with another aspect of the present disclosure, the ion generating device may include: a hollow body; a fan which is coupled to one side of the body, and causes a flow of air passing through an inside of the body; and an ionizer which is coupled to the other side of the body, and generates ion.

In accordance with another aspect of the present disclosure, the ionizer may include a case hole which is formed in a portion of the ionizer facing the inside of the body, and communicates with the inside of the body.

In accordance with another aspect of the present disclosure, the ionizer may be located between an inner surface and an outer surface of the body.

In accordance with another aspect of the present disclosure, one surface of the ionizer may define a portion of a boundary of the inside of the body, and the case hole may be formed on the one surface of the ionizer.

In accordance with another aspect of the present disclosure, the fan may be coupled to the body, and the ionizer may be horizontally spaced apart from the fan.

In accordance with another aspect of the present disclosure, the body may include: a seating portion on which the fan is mounted; and a receiving portion which protrudes from one side of the seating portion to an outer side of the seating portion, and extends along the one side, wherein the receiving portion may include a slot which is formed from one surface of the receiving portion to an inner side of the receiving portion, and into which the ionizer is inserted.

In accordance with another aspect of the present disclosure, at least a portion of the one side of the seating portion is located between the ionizer and the inside of the body, and is cut-out.

In accordance with another aspect of the present disclosure, the ionizer may further include a plurality of ionizers spaced apart from each other along a circumference of the body.

In accordance with another aspect of the present disclosure, the case hole of each of the plurality of ionizers faces the inside of the body.

In accordance with another aspect of the present disclosure, the plurality of ionizers may include: a first ionizer which generates any one of negative ion and positive ion; and a second ionizer which faces the first ionizer, and generates ion having the same polarity as the first ionizer.

In accordance with another aspect of the present disclosure, the plurality of ionizers may include: a first ionizer comprising a first discharge electrode that generates negative ion and a second discharge electrode that generates positive ion; and a second ionizer comprising a third discharge electrode that generates negative ion and a fourth discharge electrode that generates positive ion.

In accordance with another aspect of the present disclosure, the third discharge electrode faces the first discharge electrode, and the fourth discharge electrode faces the second discharge electrode.

In accordance with another aspect of the present disclosure, the housing may include a top part that forms an upper side of the housing, and to which the ion generating device is coupled.

In accordance with another aspect of the present disclosure, a lower end of the ion generating device is located in an upper side of an upper end of the heat exchanger.

In accordance with another aspect of the present disclosure, the heat exchanger may further include: a first heat exchanger; and a second heat exchanger which is located downstream of the first heat exchanger, in a passage of air formed by the fan, wherein the ion generating device is located between the first heat exchanger and the second heat exchanger.

In accordance with another aspect of the present disclosure, a portion of the top part defines an upper boundary of a space formed between the first heat exchanger and the second heat exchanger, wherein the ion generating device is disposed in a center of the portion of the top part.

In accordance with another aspect of the present disclosure, the heat exchanger may further include a third heat exchanger located downstream of the second heat exchanger, in the passage of air formed by the fan.

In accordance with another aspect of the present disclosure, the ion generating device may further include: a first ion generating device located between the first heat exchanger and the second heat exchanger; and a second ion generating device located between the second heat exchanger and the third heat exchanger.

In accordance with another aspect of the present disclosure, the number of ionizers provided in the first ion generating device is equal to or greater than the number of ionizers provided in the second ion generating device.

In accordance with another aspect of the present disclosure, the one side of the body faces the inner side of the housing, and the fan is spaced apart from the inner side of the housing in one direction.

In accordance with another aspect of the present disclosure, the ion generating device may further include a plurality of legs which extend in the one direction, have one side coupled to the body, and have the other side coupled to the inner side of the housing.

In accordance with another aspect of the present disclosure, the fan is an axial-flow fan having a rotation shaft parallel to the one direction, an upstream of the fan is located between the fan and the inner side of the housing, and a downstream of the fan is located in the inside of the body.

In accordance with another aspect of the present disclosure, the plurality of legs are expanded in the one direction, or are compressible in the other direction opposite to the one direction.

In accordance with another aspect of the present disclosure, each of the plurality of legs may include: a first part which forms the one side of the leg; a second part which is located between the one side and the other side of the leg; and a third part which forms the other side of the leg, and to which the second part is fixed, wherein the first part is coupled to the second part to be movable in the one direction or the other direction.

In accordance with another aspect of the present disclosure, the air conditioner may further include a linear actuator which is disposed inside the first part and the second part, and linearly moves the first part.

In accordance with another aspect of the present disclosure, the air conditioner may further include a controller which is electrically connected to the blower and the ion generating device.

In accordance with another aspect of the present disclosure, the controller stops the ion generating device, compresses the leg through the linear actuator, and operates the blower, in an air conditioning mode.

In accordance with another aspect of the present disclosure, the controller stops the blower, expands the leg through the linear actuator, and operates the ion generating device, in a sterilization mode.

In accordance with another aspect of the present disclosure, one of the blower and the ion generating device is operated while the other is stopped.

In accordance with another aspect of the present disclosure, the air conditioner may further include an outdoor unit which is connected to the heat exchanger through a refrigerant pipe, and has a compressor for compressing the refrigerant, wherein a refrigerant flows through the heat exchanger.

In accordance with another aspect of the present disclosure, the ion generating device may include a hollow body; a fan which is coupled to one side of the body, and causes a flow of air passing through an inside of the body; and an ionizer which is coupled to the other side of the body, and generates ion.

In accordance with another aspect of the present disclosure, the ionizer may include a case hole which is formed in a portion of the ionizer facing the inside of the body, and communicates with the inside of the body.

In accordance with another aspect of the present disclosure, the ionizer may include: an ion generator including a substrate, a discharge electrode formed on one surface of the substrate, and a ground electrode formed on the other surface of the substrate; a voltage generator for applying a voltage to the discharge electrode; and a case which provides an internal space in which the ion generator and the voltage generator are installed, and in which the case hole is formed, and the one surface of the substrate may face the case hole.

In accordance with another aspect of the present disclosure, a photocatalyst may be coated on the surface of the discharge electrode.

BRIEF DESCRIPTION OF THE DRAWINGS

The above and other objects, features and advantages of the present disclosure will be more apparent from the following detailed description in conjunction with the accompanying drawings, in which:

FIG. 25 is a view for explaining an automatic stretching mechanism of the leg, FIG. 26 is a view for explaining a state in which the leg of the ion generating device is compressed, and FIG. 27 is a view for explaining a state in which the leg of the ion generating device is expanded.

DETAILED DESCRIPTION OF THE PREFERRED EMBODIMENTS

Figure 1:
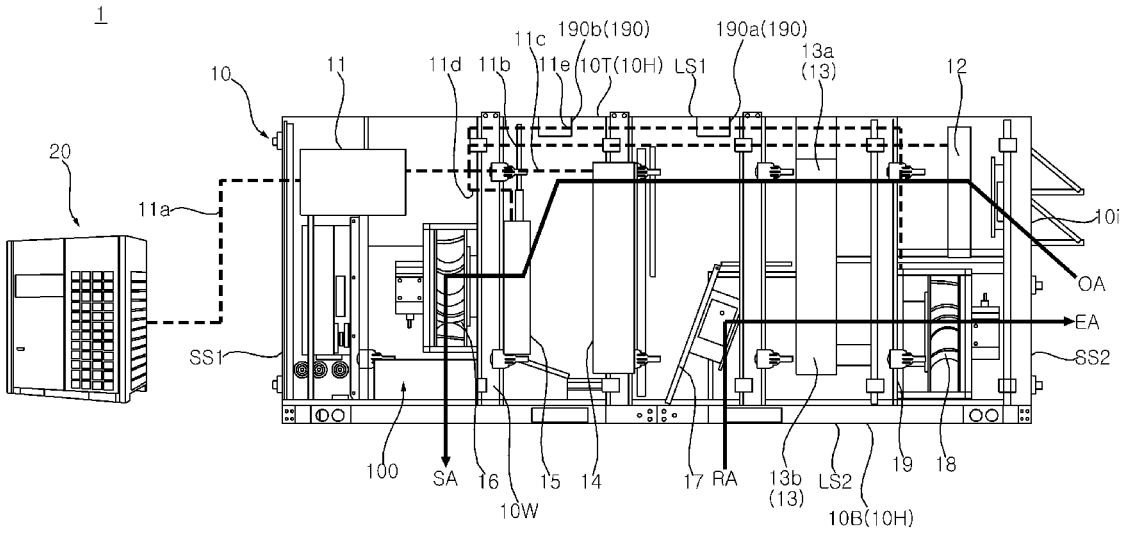
FIGS. 1 and 2 are views for explaining a configuration of an air conditioner according to an embodiment of the present disclosure.

Hereinafter, the embodiments disclosed in the present specification will be described in detail with reference to the accompanying drawings, and the same or similar elements are denoted by the same reference numerals and redundant descriptions thereof will be omitted.

In the following description, with respect to constituent elements used in the following description, the suffixes "module" and "unit" are used or combined with each other only in consideration of ease in the preparation of the specification, and do not have or serve as different meanings.

In addition, in describing the embodiments disclosed in the present specification, if it is determined that detailed descriptions of related known technologies may obscure the gist of the embodiments disclosed in the present specification, the detailed description thereof will be omitted. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents and substitutions included in the scope and sprit of the present disclosure.

Although the terms "first," "second," etc., may be used herein to describe various components, these components should not be limited by these terms. These terms are only used to distinguish one component from another component.

These terms are only used to distinguish one component from another component. When a component is referred to as being "connected to" or "coupled to" another component, it may be directly connected to or coupled to another component or intervening components may be present. In contrast, when a component is referred to as being "directly connected to" or "directly coupled to" another component, there are no intervening components present.

As used herein, the singular form is intended to include the plural forms as well, unless the context clearly indicates otherwise.

In the following description, even if the embodiment is described with reference to specific drawings, if necessary, reference numerals not appearing in the specific drawings may be referred to, and reference numerals not appearing in the specific drawings are used when the reference numerals appear in the other figures.

Figure 2:
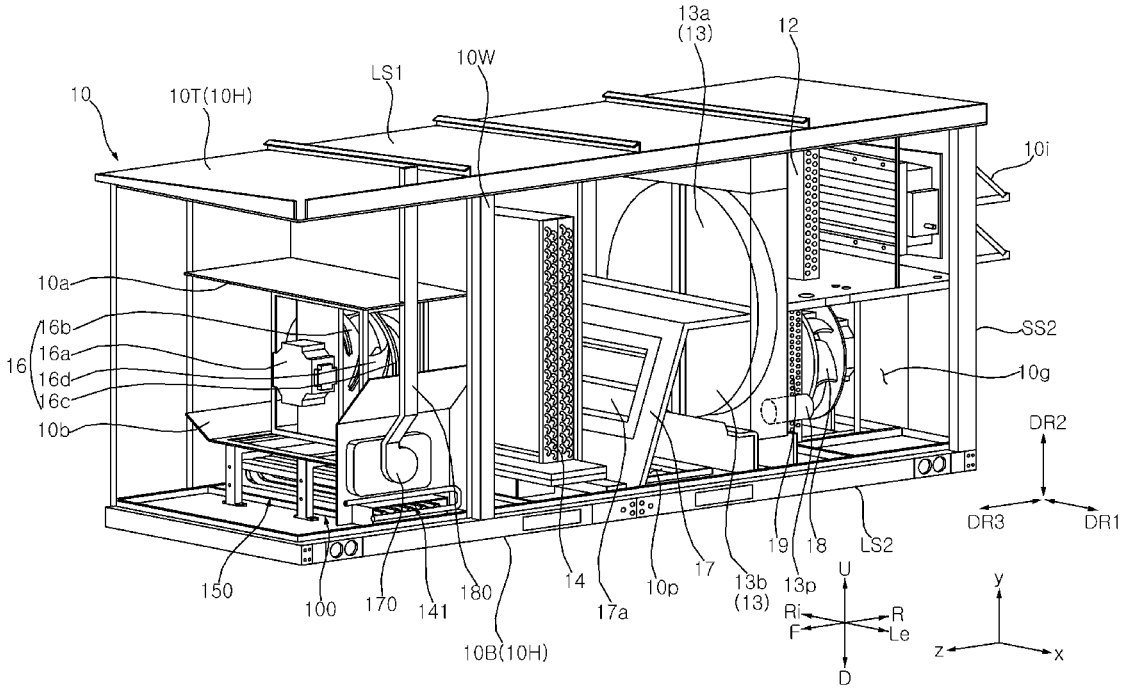

The directions of up (U, y), down (D), left (Le, x), right (Ri), front (F, z), and rear (R) indicated in FIG. 2 are used for convenience of explanation, and the technical concept of the present disclosure is not limited thereto.

Referring to FIGS. 1 and 2, an air conditioner 1 may include an outdoor unit 20 and a ventilation device 10. The outdoor unit 20 may include a compressor (not shown) that compresses a refrigerant and an outdoor heat exchanger (not shown) that heat-exchanges the refrigerant with outdoor air. The outdoor unit 20 may be connected to the ventilation device 10 through a first refrigerant pipe 11*a*. The refrigerant may circulate the outdoor unit 20 and the ventilation device 10 through the refrigerant pipe.

A housing 10H may include a first long side LS1 and a second long side LS2 facing the first long side LS1. The first long side LS1 and the second long side LS2 may be collectively referred to as a long side LS1, LS2. The housing 10H may include a first short side SS1 adjacent to the long side LS1, LS2 and a second short side SS2 facing the first short side SS1. The first short side SS1 and the second short side SS2 may be collectively referred to as a short side SS1, SS2.

A direction perpendicular to the long side LS1, LS2 and the short side SS1, SS2 may be referred to as a first direction DR1 or a left-right direction. A direction parallel to the short side SS1, SS2 may be referred to as a second direction DR2 or an up-down direction. A direction parallel to the long side LS1, LS2 may be referred to as a third direction DR3 or a front-rear direction.

The side of the first long side LS1 may be referred to as an upper side (U, y), and the side of the second long side LS2 may be referred to as the lower side D. The side of the first short side SS1 may be referred to as a front (F, z), and the side of the second short side SS2 may be referred to as a rear (R). In the first direction DR1, the direction toward one end of the short side SS1, SS2 may be referred to as a left side (Le, x), and the direction toward the other end of the short side SS1, SS2 may be referred to as a right side Ri.

A portion forming the first long side LS1 of the housing 10H may be referred to as a top part 10T, and a portion forming the second long side LS2 of the housing 10H may be referred to as a bottom part 10B.

The ventilation device 10 may include a refrigerant distributor 11, a plurality of heat exchangers 12, 13, 14, 15, 19, a blower 16, a damper mount 17, and an exhaust fan 18. The refrigerant distributor 11, the plurality of heat exchangers 12, 13, 14, 15, 19, the blower 16, the damper mount 17, and the exhaust fan 18 may be installed inside the housing 10H.

A supply air passage OA-SA may be formed between a first inlet port 10*i* and a first outlet port (not shown). The first inlet port 10*i* may be formed to penetrate the second short side SS2, and may be adjacent to the first long side LS1. The first outlet port may be formed to penetrate the second long side LS2, and may be adjacent to the first short side SS1. An outdoor air OA may flow into the first inlet port 10*i*, and the first inlet port 10*i* may be referred to as an outdoor air inlet. A supply air SA may be supplied into the room through the first outlet port, and the first outlet port may be referred to as a supply air outlet.

The blower 16 may be located in the supply air passage OA-SA while being adjacent to the first outlet port. The blower 16 may cause a flow of air along the supply air passage OA-SA. The blower 16 may be referred to as an supply air fan 16 or a plug fan. Meanwhile, an supply air duct (not shown) may be connected to the second long side LS2, and may communicate with the first outlet port and the indoor space. For example, the air volume per minute of the blower 16 may be 3,000 to 5,000 cubic feet per minute (CFM).

An exhaust air passage RA-EA may be formed between a second inlet port 10*p* and a second outlet port 10*g*. The second inlet port 10*p* may be formed to penetrate the second long side LS2, and may be spaced apart from the first outlet port. The second outlet port 10*g* may be formed to penetrate the second short side SS2, and may be adjacent to the second long side LS2. A room air or return air (RA) may flow into the second inlet port 10*p*, and the second inlet port 10*p* may be referred to as a room air inlet. An exhaust air EA may be discharged to the outside through the second outlet port 10*g*, and the second outlet port 10*g* may be referred to as an exhaust air outlet.

The exhaust fan 18 may be located in the exhaust air passage RA-EA while being adjacent to the second outlet port 10*g*. The exhaust fan 18 may cause a flow of air along the exhaust air passage RA-EA. The exhaust fan 18 may be referred to as a blower or a plug fan. Meanwhile, a room air duct (not shown) may be connected to the second long side LS2, and may communicate with the second inlet port 10*p* and the indoor space.

The damper mount 17 may divide an inner space of the housing 10H, between a recovery wheel 13 described later and the heat exchanger 14, into a space where the supply air passage OA-SA is formed, and a space where the exhaust air passage RA-SA is formed. The damper mount 17 may be installed near the second inlet port 10*p* of the housing 10H, and may include an inclined portion (no reference numeral) and a horizontal portion (no reference numeral). Accordingly, the supply air passage OA-SA may be located in the upper side of the damper mount 17, and the exhaust air passage RA-SA may be located in the lower side of the damper mount 17.

The damper 17*a* may be installed in the inclined portion of the damper mount 17. When the damper 17*a* is opened, the supply air passage OA-SA and the exhaust air passage RA-SA may communicate with each other. When the damper 17*a* is closed, the supply air passage OA-SA and the exhaust air passage RA-SA may be separated from each other. For example, in the initial stage of the heating operation of the air conditioner, the blower 16 may be operated while the exhaust fan 18 may be stopped, and the damper 17*a* may be opened.

The refrigerant distributor 11 may be adjacent to the first long side LS1 and the first short side SS1. One side of the refrigerant distributor 11 may be connected to the first refrigerant pipe 11*a*. The other side of the refrigerant distributor 11 may be connected to a plurality of refrigerant pipes 11*b*, 11*c*, 11*d*, and 11*e*. For example, the refrigerant distributor 11 may open and close the passage of each refrigerant pipe through a solenoid valve. Here, each refrigerant pipe 11*b*, 11*c*, 11*d*, 11*e* may include a refrigerant pipe providing a passage of the refrigerant supplied to each heat exchanger 12, 14, 15, 19, and a refrigerant pipe providing a passage of the refrigerant passing through each heat exchanger 12, 14, 15, 19. In addition, each expansion valve (not shown) may be connected to each refrigerant pipe 11*b*, 11*c*, 11*d*, 11 *e*, and may expand the refrigerant flowing through each refrigerant pipe 11*b*, 11*c*, 11*d*, and 11*e*. For example, the expansion valve may be an electronic expansion valve (EEV) capable of adjusting the opening degree.

In this case, when the expansion valve is fully opened, the expansion valve may not expand the refrigerant.

A radiator 12 may be located in the supply air passage OA-SA while being adjacent to the first inlet port 10*i*. The high-temperature cooling water described later may pass through the radiator 12. Accordingly, the radiator 12 may heat the air introduced into the first inlet port 10*i*. The radiator 12 may be referred to as a radiant heat coil.

The heat exchanger 14 may be located downstream of the radiator 12 in the supply air passage OA-SA. The heat exchanger 14 may be vertically disposed inside the housing 10H. The size of the heat exchanger 14 may be larger than the size of the radiator 12. The second refrigerant pipe 11*c* may provide a refrigerant passage connecting the refrigerant distributor 11 and the heat exchanger 14. The heat exchanger 14 may be referred to as a main heat exchanger or a cooling/heating coil. The heat exchanger 14 may be referred to as a second heat exchanger 14. Meanwhile, a filter 14*a* (see FIG. 23) may be located upstream of the heat exchanger 14.

A reheater 15 may be located downstream of the heat exchanger 14 in the supply air passage OA-SA. The reheater 15 may be vertically disposed inside the housing 10H. The size of the reheater 15 may be smaller than the size of the heat exchanger 14. The third refrigerant pipe 11*d* may provide a refrigerant passage connecting the refrigerant distributor 11 and the reheater 15. The reheater 15 may be referred to as a reheat coil. The reheater 15 may be referred to as a third heat exchanger 15.

Meanwhile, the reheater 15 may be operated based on the indoor set temperature and set humidity. The reheater 15 may face the blower 16 with respect to a base 10W on which the reheater 15 is installed.

A recovery coil 19 may be located in the exhaust air passage RA-EA while being adjacent to the exhaust fan 18. The recovery coil 19 may be vertically disposed inside the housing 10H. The fourth refrigerant pipe 11*e* may provide a refrigerant passage connecting the refrigerant distributor 11 and the recovery coil 19. Meanwhile, the heat transfer direction of the recovery coil 19 with respect to the air may be opposite to the heat transfer direction of the heat exchanger 14 with respect to the air.

A recovery wheel 13 may have a flat cylinder shape as a whole. A honeycomb structure may be formed inside the recovery wheel 13, and air may pass through the honeycomb structure. The recovery wheel 13 may be rotated by the power of a motor 13*p*. A rotation shaft of the recovery wheel 13 may be a length direction shaft of the recovery wheel 13, and the recovery wheel 13 may rotate in a circumferential direction of the recovery wheel 13. For example, the power of the motor 13*p* may be transmitted to the recovery wheel 13 using a belt and a pulley.

In addition, a first portion 13*a* of the recovery wheel 13 may be located in the supply air passage OA-SA. In the supply air passage OA-SA, the first portion 13*a* may be located between the radiator 12 and the heat exchanger 14. In addition, a second portion 13*b* of the recovery wheel 13 may be located in the exhaust air passage RA-EA. In the exhaust air passage RA-EA, the second portion 13*b* may be located between the inclined portion of the damper mount 17 and the recovery coil 19. In this case, a portion corresponding to the first portion 13*a* or the second portion 13*b* of the recovery wheel 13 may be changed in response to the rotation of the recovery wheel 13. The recovery wheel 13 may be referred to as a first heat exchanger 13.

Accordingly, the recovery wheel 13 may recover sensible heat and latent heat by using the temperature difference and humidity difference between the outdoor air OA and the room air RA. The recovery wheel 13 may be referred to as an energy recovery wheel (ERW).

Figure 3:
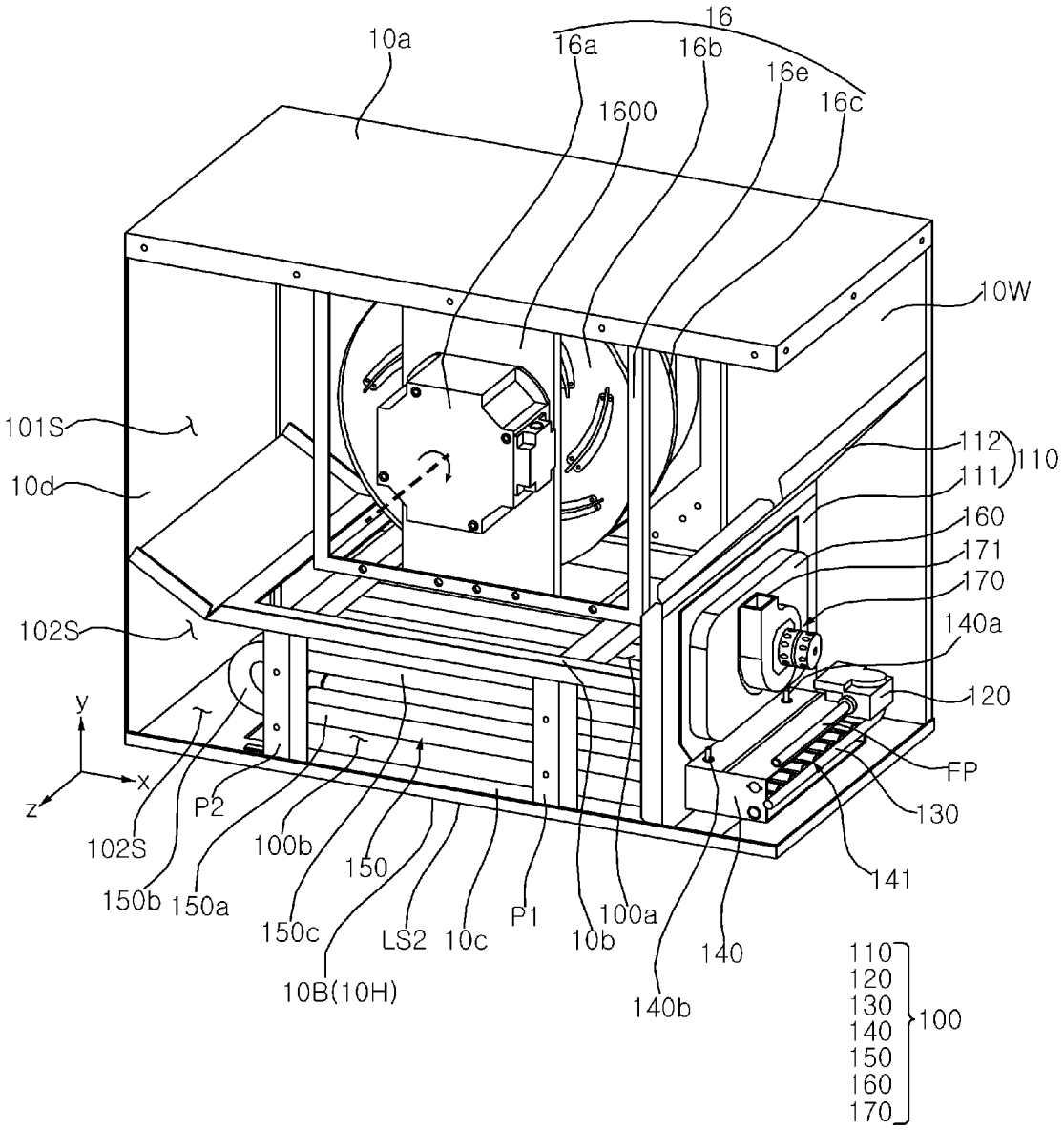
FIG. 3 is a view for explaining a gas furnace of an air conditioner according to an embodiment of the present disclosure.

Referring to FIGS. 2 and 3, the blower 16 may include a motor 16*a*, a hub 16*b*, a shroud 16*c*, and a plurality of blades 16*d*. The hub 16*b*, the shroud 16*c*, and the plurality of blades 16*d* may be collectively referred to as an impeller.

The motor 16*a* may provide rotational force. The motor 16*a* may be a centrifugal fan motor. The motor 16*a* may form a front end of the blower 16, and the rotational shaft of the motor 16*a* may extend rearward from the motor 16*a*. The length direction of the rotation shaft of the motor 16*a* may be referred to as a shaft direction of the blower 16.

The hub 16*b* may be located in the rear of the motor 16*a* and may be fixed to the rotation shaft of the motor 16*a*. The hub 16*b* may have a disk shape.

The shroud 16*c* may be located at the rear of the hub 16*b* and may have a ring plate shape. The shroud 16*c* may be rotatably coupled to the base 10W. For example, an inflow portion (no reference numeral) may be fixed to the front surface of the base 10W, between the shroud 16*c* and the base 10W, and may have a hyperbolic cylinder or funnel shape. In this case, the shroud 16*c* may be rotatably coupled to the inflow portion. The hole formed inside the shroud 16*c*, the inner space of the inflow portion, and a hole (not shown) formed in the base 10W may communicate with each other, and may be located in the supply air passage OA-SA (see FIG. 1).

The plurality of blades 16*d* may be located between the inner periphery and the outer periphery of the ring-shaped shroud 16*c*. The plurality of blades 16*d* may be coupled to the hub 16*b* and the shroud 16*c*, between the hub 16*b* and the shroud 16*c*. The plurality of blades 16*d* may be formed as one body with the shroud 16*c* and the hub 16*b*.

In addition, the plurality of blades 16*d* may be spaced apart from each other in the rotational direction of the rotation shaft of the motor 16*a*. Each of the plurality of blades 16*d* may be convexly curved in the rotational direction of the rotation shaft. For example, a blade located close to a mount plate 110 described later, among the plurality of blades 16*d*, may be convex toward the mount plate 110.

Accordingly, when the impeller 16*a*, 16*b*, 16*c* rotates clockwise according to the driving of the motor 16*a*, air may be introduced in the shaft direction of the blower 16 through the hole of the base 10W, and may be pressed by the plurality of blades 16*d* to be discharged in the radial direction of the blower 16.

A horizontal plate 10*a* may be vertically disposed on the front surface of the base 10W, and may be coupled to the front surface of the base 10W. The horizontal plate 10*a* may be located in the upper side of the blower 16. The horizontal plate 10*a* may be referred to as a first horizontal wall or a first panel. Meanwhile, the frame 16*e* may form a skeleton of the blower 16, and may be coupled to a motor mount 1600 in which the motor 16*a* is mounted. The frame 16*e* may be coupled to the lower side of the horizontal plate 10*a*.

A top plate 10*b* may be vertically disposed on the front surface of the base 10W, and may be coupled to the front surface of the base 10W. The top plate 10*b* may be located in the lower side of the blower 16. The top plate 10*b* may be referred to as a second horizontal wall or a second panel. A top hole 100*a* may be formed to penetrate the top plate 10*b* in the up-down direction. The top hole 100*a* may be formed to be long in the left-right direction. In the up-down direction, at least a portion of the top hole 100*a* may overlap with the blower 16.

A bottom plate 10*c* may be vertically disposed on the front surface of the base 10W, and may be coupled to the front surface of the base 10W. The bottom plate 10*c* may face the horizontal plate 10*a* with respect to the top plate 10*b*. The bottom plate 10*c* may form a part of the second long side LS2 of the housing 10H. A bottom hole 100*b* may be formed to penetrate the bottom plate 10*c* in the up-down direction. The bottom hole 100*b* may be formed to be long in the left-right direction. In the up-down direction, the bottom hole 100*b* may face the top hole 100*a*.

A side plate 10*d* may be vertically disposed on the front surface of the base 10W, and may be coupled to the front surface of the base 10W. The side plate 10*d* may be coupled to a right side of the horizontal plate 10*a*, a right side of the top plate 10*b*, and a right side of the bottom plate 10*c*.

The mount plate 110 may include a first plate 111 and a second plate 112. The first plate 111 may be vertically disposed on the front surface of the base 10W and the upper surface of the bottom plate 10*c*, and may be coupled to the front surface of the base 10W and the upper surface of the bottom plate 10*c*. The first plate 111 may be coupled to the left side of the top plate 10*b*. The second plate 112 may extend obliquely from the upper end of the first plate 111 in a direction away from the blower 16. In this case, the left side of the base 10W, the left side of the horizontal plate 10*a*, the left side of the second plate 112, and the left side of the bottom plate 10*c* may be connected to the left portion of the housing 10H.

A first space 101S may be formed between the horizontal plate 10*a* and the top plate 10*b*. A vertical plate (not shown) may be connected to the front end of the horizontal plate 10*a* and the front end of the top plate 10*b*, and may close the front of the first space 101S.

A second space 102S may be formed between the top plate 10*b* and the bottom plate 10*c*. The vertical plate may be connected to the front end of the top plate 10*b* and the front end of the bottom plate 10*c*, and may close the front of the second space 102S. The second space 102S may communicate with the first space 101S through the top hole 100*a*, and may communicate with the indoor space through the bottom hole 100*b*.

Referring back to FIG. 3, a gas furnace 100 may include a fuel valve 120, a manifold 130, a burner 141, a heat exchanger 150, a collect box 160, and an inducer 170.

The fuel valve 120 may supply fuel from a fuel pipe (not shown) to the manifold 130, or may block the supply of the fuel to the manifold 130. For example, the fuel may be a liquefied natural gas (LNG) or a liquefied petroleum gas (LPG). Meanwhile, the amount of the fuel supplied to the manifold 130 may be adjusted by adjusting the opening degree of the fuel valve 120. In other words, the thermal power of the gas furnace 100 may be adjusted in stages by using the fuel valve 120. The fuel valve 120 may be referred to as a modulating valve.

The burner 141 may be supplied with the fuel from the manifold 130. For example, primary air may flow into the burner 141 through a space between the burner 141 and the manifold 130. In this case, the fuel may pass through the burner 141 and be mixed with the primary air. The burner 141 may burn the fuel. When the fuel is burned, a flame and high-temperature combustion gas may be generated. For example, a plurality of burners 141 may be provided. The plurality of burners 141 may be installed inside a burner box 140. The burner box 140 may be installed in the left side of the first plate 111 of the mount plate 110.

For example, an igniter 140*a* may be adjacent to an exit of burner located in one end of the plurality of burners 141, and may burn fuel that has passed through the burner. In this case, the flame formed in the exit of the burner may be propagated to the exit of the remaining burners through a flame propagation port between the plurality of burners 141. The propagated flame may burn fuel that has passed through the remaining burners. In addition, a flame detector 140*b* may be adjacent to the exit of burner located in the other end of the plurality of burners 141. When the flame detector 140*b* detects a flame, it can be considered that the flame according to the combustion reaction is formed in the remaining burners due to the characteristics of the flame propagation described above.

The heat exchanger 150 may be located in the second space 102S between the top plate 10*b* and the bottom plate 10*c*. The heat exchanger 150 may provide a passage for the combustion gas. One end of the heat exchanger 150 may be coupled to the right side of the first plate 111 of the mount plate 110. The other end of the heat exchanger 150 may be spaced apart from the one end of the heat exchanger 150, and may be coupled to the right side of the first plate 111.

In addition, a plurality of heat exchangers 150 may be provided. The number of heat exchangers 150 may be the same as the number of burners 141. Each of the plurality of heat exchangers 150 may be connected to each of the plurality of burners 141. The plurality of heat exchangers 150 may be spaced apart from each other in the front-rear direction.

In addition, the heat exchanger 150 may be a tubular type heat exchanger. The heat exchanger 150 may include a first tube 150*a*, a band 150*b*, and a second tube 150*c*. The passage of the combustion gas may be formed in the inside of the first tube 150*a*, the inside of the band 150*b*, and the inside of the second tube 150*c*. For example, the diameter of the first tube 150*a* may be substantially equal to the diameter of the band 150*b* and the diameter of the second tube 150*c*.

The first tube 150*a* may extend long in the left-right direction. The left distal end of the first tube 150*a* may form the one end of the heat exchanger 150, and may be referred to as an entrance of the heat exchanger 150. The entrance of the heat exchanger 150 may communicate with the burner 141 through a first hole (not shown) formed in the first plate 111.

The second tube 150*c* may extend long in the left-right direction. The second tube 150*c* may be spaced upwardly from the first tube 150*a*. The left distal end of the second tube 150*c* may form the other end of the heat exchanger 150, and may be referred to as an exit of the heat exchanger 150. The exit of the heat exchanger may communicate with the inside of the collect box 160 described later through a second hole (not shown) formed in the first plate 111.

The band 150*b* may be connected to the right distal end of the first tube 150*a* and the right distal end of the second tube 150*c*. The band 150*b* may be formed to be convex to the right. The band 150*b* may transmit the combustion gas passing through the first tube 150*a* to the second tube 150*c*. Accordingly, the combustion gas may flow to the right in the first tube 150*a*, and may flow to the left in the second tube 150*b*. The band 150*b* may be referred to as a U-shaped bend.

The collect box 160 may be located in the upper side of the burner box 140, and may be installed in the left side of the first plate 111 of the mount plate 110. The combustion gas passing through the heat exchanger 150 may flow into the inside of the collect box 160.

The inducer 170 may be installed in the left side of the collect box 160. The entrance of the inducer 170 may communicate with the inside of the collect box 160. An exit 171 of the inducer 170 may be connected to an exhaust pipe 180 (see FIG. 2). The inducer 170 may cause the combustion gas to flow through the heat exchanger 150, the collector box 160, the inducer 170, and the exhaust pipe 180. In addition, the inducer 170 may cause the fluid to flow through the burner 141. Meanwhile, the inducer 170 may be referred to as a fan.

The exhaust pipe 180 (see FIG. 2) may extend upwardly from the exit 171 of the inducer 170. The exhaust pipe 180 may penetrate the second plate 112 of the mount plate 110, the horizontal plate 10*a*, and the first long side LS1, and may discharge the combustion gas to the outside. The combustion gas flowing through the exhaust pipe 180 may be referred to as exhaust gas. For example, the temperature of the exhaust gas may be about 250 to 300° C.

Accordingly, the air discharged from the blower 16 may pass around the heat exchanger 150 via the top hole 100*a*, and may be supplied into the room through the bottom hole 100*b*. Here, the bottom hole 100*b* may be the first outlet port described above with reference to FIGS. 1 and 2. At this time, the air passing around the heat exchanger 150 may receive heat energy from the combustion gas flowing along the heat exchanger 150. That is, the temperature of the air may rise while passing around the heat exchanger 150.

Figure 4:
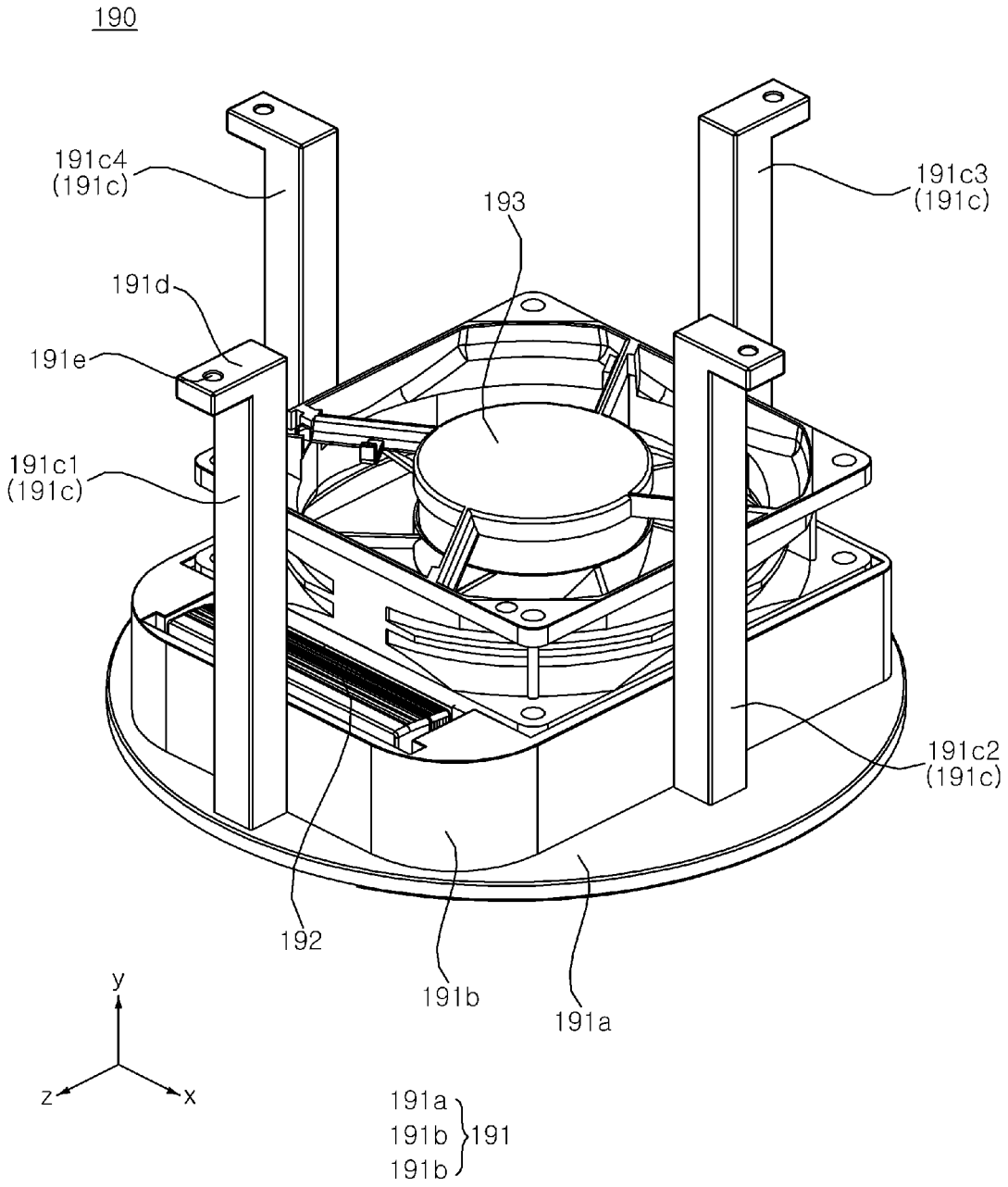
FIG. 4 is a perspective view of an ion generating device of an air conditioner according to an embodiment of the present disclosure.

Referring to FIGS. 1 and 4, an ion generating device 190 may be mounted inside the top part 10T which is a portion forming the first long side LS1 of the housing 10H. The ion generating device 190 may be referred to as an ion supply device or a sterilization device.

The ion generating device 190 may include a bracket 191, an ionizer 192, and a fan 193. The bracket 191 may be fixed to the inside of the housing 10H, and the ionizer 192 and the fan 193 may be detachably coupled to the bracket 191.

Figure 5:
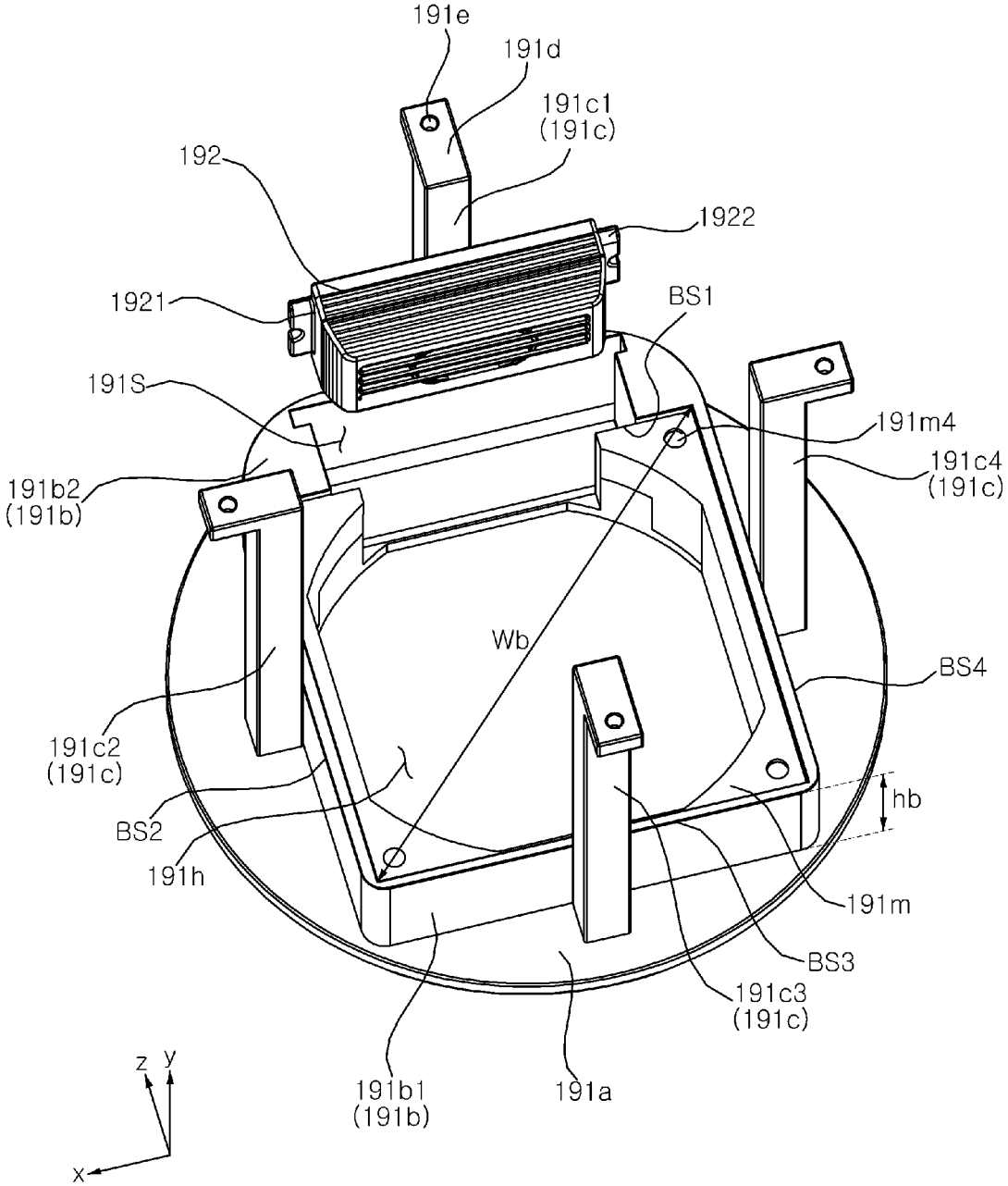
FIGS. 5 and 6 are views for explaining an ionizer of an ion generating device according to an embodiment of the present disclosure.

Referring to FIG. 5, the bracket 191 may include a base 191*a*, a body 191*b*, and a plurality of legs 191*c*.

The base 191*a* may form a lower surface of the bracket 191. The base 191*a* may have a ring shape as a whole. That is, in the up-down direction, a discharge hole 191*h* may penetrate the upper and lower surfaces of the bracket 191. The base 191*a* may be referred to as a ring plate or a bottom plate.

The body 191*b* may protrude upward from the top surface of the base 191*a*. The body 191*b* may have a hollow block shape as a whole. That is, the body 191*b* may be opened vertically. In the up-down direction, the discharge hole 191*h* may penetrate the upper and lower surfaces of the body 191*b*. The body 191*b* may be referred to as a block. In addition, the body 191*b* may include a seating portion 191*b*1 and a receiving portion 191*b*2. All parts of the seating portion 191*b*1 and the receiving portion 191*b*2 may be located on the base 191*a*.

The seating portion 191*b*1 may have four sides BS1, BS2, BS3, and BS4 that are orthogonal to each other. The aforementioned discharge hole 191*h* may be formed in the seating portion 191*b*1. A diagonal length wb of the seating portion 191*b*1 may be greater than a height hb of the seating portion 191*b*1.

The receiving portion 191*b*2 may protrude from the first side BS1 of the seating portion 191*b*1 in the radial direction of the base 191*a*. The receiving portion 191*b*2 may extend along the first side BS1, and may be formed as one body with the second side BS2 and the fourth side BS4 of the seating portion 191*b*1. Here, the second side BS2 and the fourth side BS4 may be connected to the first side BS1, and may face each other with respect to the first side BS1. The height of the receiving portion 191*b*2 may be the same as the height hb of the seating portion 191*b*1.

A slot 191S may be formed inside the receiving portion 191*b*2 from the upper surface of the receiving portion 191*b*2. A portion of the first side BS1 may be cut-out, and the slot 191S may communicate with the discharge hole 191*h* through the portion of the first side BS1. The shape of the slot 191S may correspond to the shape of the ionizer 192.

In this case, the ionizer 192 may be detachably inserted into the slot 191S. That is, the ionizer 192 may be located between the inner surface and the outer surface of the body 191*b*. The ionizer 192 inserted into the slot 191S may be detachably coupled to the inside of the receiving portion 191*b*2 through a coupling portion 1921, 1922. The ionizer 192 coupled to the receiving portion 191*b*2 may communicate with the discharge hole 191*h*.

The plurality of legs 191*c* may be fixed to the upper surface of the base 191*a*. The plurality of legs 191*c* may be located around the body 191*b*. For example, a first leg 191*c*1 may face the first side BS1 with respect to the receiving portion 191*b*2. In addition, each of a second leg 191*c*2, a third leg 191*c*3, and a fourth leg 191*c*4 may face each of the second side BS2, the third side BS3, and the fourth side BS4.

In addition, the plurality of legs 191*c* may extend in the up-down direction. The height of the plurality of legs 191*c* may be greater than the sum of the above-described height hb of the body 191*b* and the height of the fan 193 (see FIG. 4).

In addition, a foot 191*d* may be bent to the outside of the bracket 191 from the upper end of the leg 191*c*. The foot 191*d* may be orthogonal to the leg 191*c*, and may contact the inside of the top part 10T (see FIG. 1) which is a portion forming the first long side LS1 of the housing 10H. A fastening member such as a screw may be coupled to the inside of the housing 10H through a hole 191*e* formed in the foot 191*d*.

Accordingly, the bracket 191 may be detachably coupled to the inner side of the housing 10H. In this case, the components (see FIG. 4) of the ion generating device 190 excluding the foot 191*d* may be spaced apart from the inner side of the housing 10H to the lower side.

Figure 6:
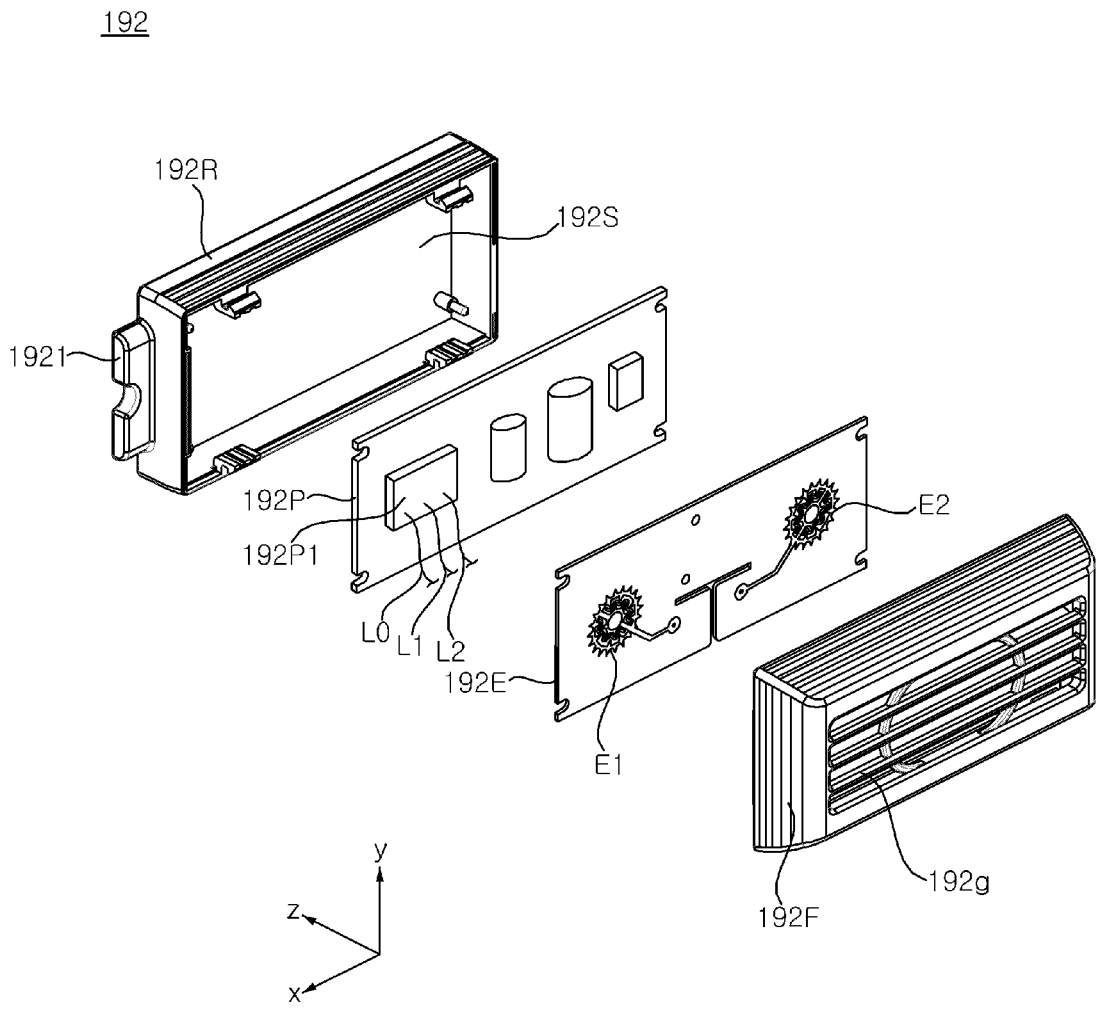

Referring to FIG. 6, the ionizer 192 may include a case 192R, 192F, a voltage generator 192P, and an ion generator 192E.

The case 192R, 192F may be extended long. The case 192R, 192F may include a rear case 192R and a front case 192F that are detachably coupled to each other. The internal space 192S of the case 192R, 192F may be formed between the rear case 192R and the front case 192F. The above-described coupling portions 1921, 1922 (see FIG. 5) may be formed in a side surface of the rear case 192R. A case hole 192*g* may be formed in the front surface of the front case 192F and may communicate with the internal space 192S. For example, the front surface of the case 192F may have a grille shape.

The voltage generator 192P may be installed in the internal space 192S and may be connected to a power source (not shown). The voltage generator 192P may include a printed circuit board PCB (no reference numeral) and a transformer 192P1 mounted on the PCB. The voltage generator 192P may be electrically connected to the ion generator 192E described later through a wire L1, L2, L0, and may apply a high voltage to the ion generator 192E. The voltage generator 192P may be referred to as a high voltage generator.

The ion generator 192E may be installed in the internal space 192S, and may be located between the voltage generator 192P and the front case 192F. That is, the ion generator 192E may face the case hole 192*g*. The electrodes E1 and E2 may be formed on the surface of the ion generator 192E. When a high voltage is applied to the electrodes E1 and E2 by the voltage generator 192P, ions may be generated, which will be described in more detail later.

Figure 7:
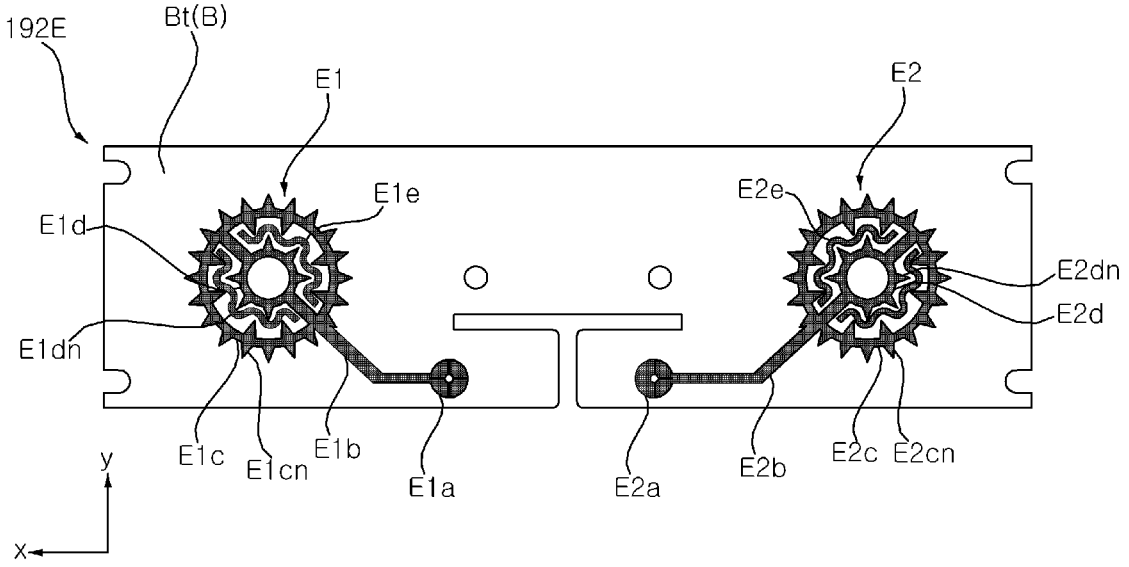
FIGS. 7 and 8 are views for explaining an ion generating device of an ionizer according to an example of the present disclosure.
Figure 8:
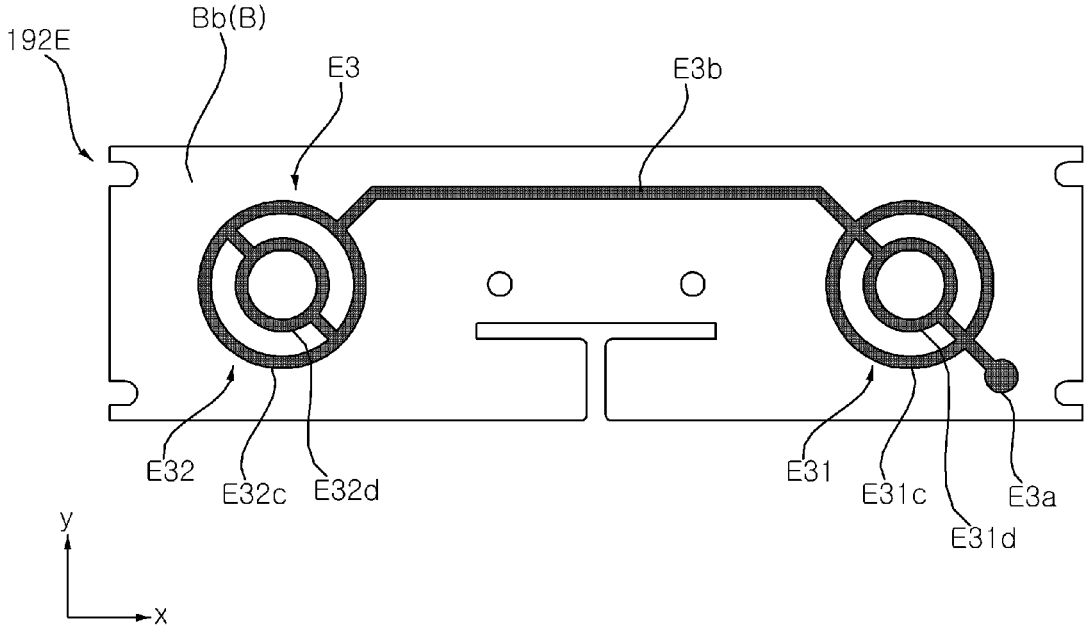

Referring to FIGS. 7 and 8, the ion generator 192E may include a substrate B, a discharge electrode E1, E2, and a ground electrode E3.

The substrate B may be formed of a dielectric substance. For example, the substrate B may include a ceramic or synthetic resin material. A first surface Bt of the substrate B may face the case hole 192*g* (see FIG. 6), and a second surface Bb of the substrate B may face the voltage generator 192P. The first surface Bt may be referred to as a front surface or an upper surface, and the second surface Bb may be referred to as a rear surface or a lower surface.

The discharge electrode E1, E2 may be formed on the first surface Bt of the substrate B. The discharge electrode E1, E2 may include a metal material such as copper Cu. For example, the discharge electrode E1, E2 may include a first discharge electrode E1 and a second discharge electrode E2 spaced apart from each other in the length direction of the substrate B. For example, the first discharge electrode E1 and the second discharge electrode E2 may be symmetrical vertically.

The first discharge electrode E1 may include a first point E1*a*, a first line E1*b*, a first outer circle E1*c*, and a first inner circle E1*d*.

The first point E1*a* may be connected to a first wire L1 (see FIG. 6), and may be a portion to which the voltage of the voltage generator 192P (see FIG. 6) is applied. The first point E1*a* may be referred to as a first terminal.

The first line E1*b* may connect the first point E1*a* and first circles E1*c* and E1*d*.

The first outer circle E1*c* and the first inner circle E1*d* may be a concentric circle. A diameter of the first outer circle E1*c* may be greater than a diameter of the first inner circle E1*d*. A portion of the aforementioned first line E1*b* may be connected to the first outer circle E1*c* and the first inner circle E1*d* from between the first outer circle E1*c* and the first inner circle E1*d*.

In addition, the first outer circle E1*c* may include first outer needles E1*cn*. In addition, the first inner circle E1*d* may include first inner needles E1*dn*. For example, the number of the first outer needles E1*cn* may be greater than the number of the first inner needles E1*dn*. Meanwhile, a barrier E1*e* may be located between the first outer circle E1*c* and the first inner circle E1*d*, and may minimize discharge interference between the first outer needles E1*cn* and the first inner needles E1*dn*.

The second discharge electrode E2 may include a second point E2*a*, a second line E2*b*, a second outer circle E2*c*, and a second inner circle E2*d*.

The second point E2*a* may be connected to a second wire L2 (see FIG. 6), and may be a portion to which the voltage of the voltage generator 192P (see FIG. 6) is applied. The second point E2*a* may be referred to as a second terminal.

The second line E2*b* may connect the second point E2*a* and the second circles E2*c* and E2*d*.

A second outer circle E2*c* and a second inner circle E2*d* may be a concentric circle. A diameter of the second outer circle E2*c* may be greater than a diameter of the second inner circle E2*d*. A portion of the aforementioned second line E2*b* may be connected to the second outer circle E2*c* and the second inner circle E2*d*, from between the second outer circle E2*c* and the second inner circle E2*d*.

In addition, the second outer circle E2*c* may include second outer needles E2*cn*. In addition, the second inner circle E2*d* may include second inner needles E2*dn*. For example, the number of the second outer needles E2*cn* may be greater than the number of the second inner needles E2*dn*. Meanwhile, a barrier E2*e* may be located between the second outer circle E2*c* and the second inner circle E2*d*, and may minimize discharge interference between the second outer needle E2*cn* and the second inner needles E2*dn*.

A ground electrode E3 may be formed on the second surface Bb of the substrate B. The ground electrode E3 may include a metal material such as copper Cu. For example, the ground electrode E3 may include a ground point E3*a*, a connector E3*b*, a first ground electrode E31, and a second ground electrode E32. The ground point E3*a* may be connected to a wire L0 (see FIG. 6). The connector E3*b* may connect the ground point E3*a* to the first and second ground electrodes E31 and E32.

In addition, in a thickness direction of the substrate B, the first ground electrode E31 may be aligned with the first discharge electrode E1. The first ground electrode E31 may have a shape corresponding to the first outer circle Etc and the first inner circle E1*d* of the first discharge electrode E1.

In addition, in the thickness direction of the substrate B, the second ground electrode E32 may be aligned with the second discharge electrode E2. The second ground electrode E32 may have a shape corresponding to the second outer circle E2*c* and the second inner circle E2*d* of the second discharge electrode E2.

Accordingly, when a high voltage is applied to the discharge electrodes E1 and E2 by the voltage generator 192P, the discharge electrodes E1 and E2 may generate a negative ion and/or a positive ion. That is, the first discharge electrode E1 may be a negative ion discharge electrode that generates a negative ion or a positive ion discharge electrode that generates a positive ion. In addition, the second discharge electrode E2 may be a negative ion discharge electrode that generates a negative ion or a positive ion discharge electrode that generates a positive ion.

Figure 9:
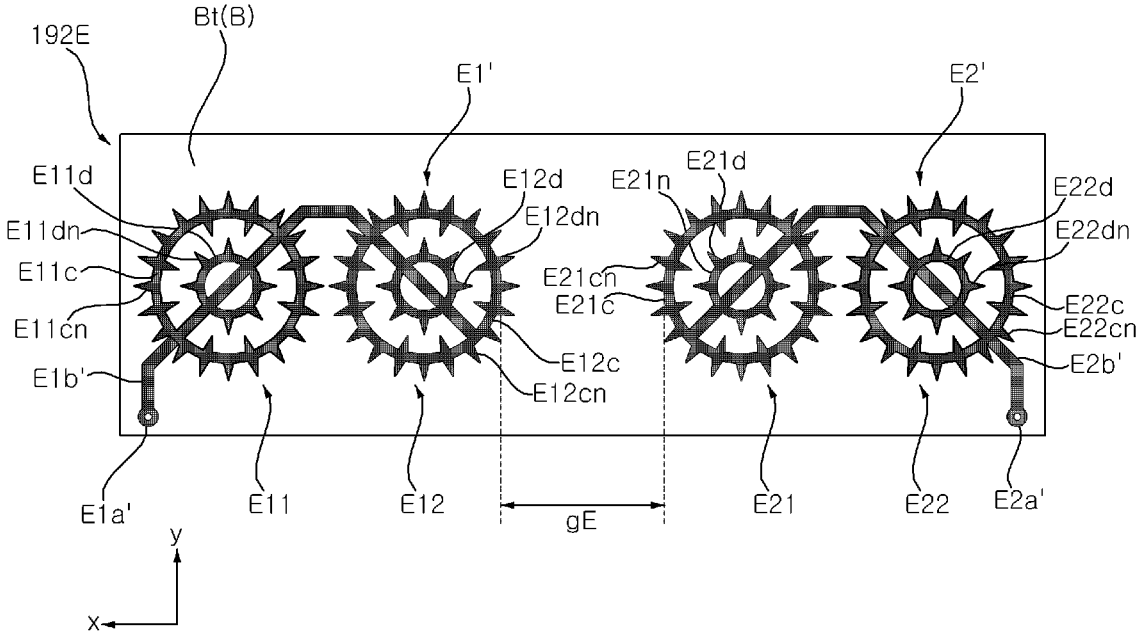
FIGS. 9 and 10 are views for explaining an ion generating device of an ionizer according to another example of the present disclosure.
Figure 10:
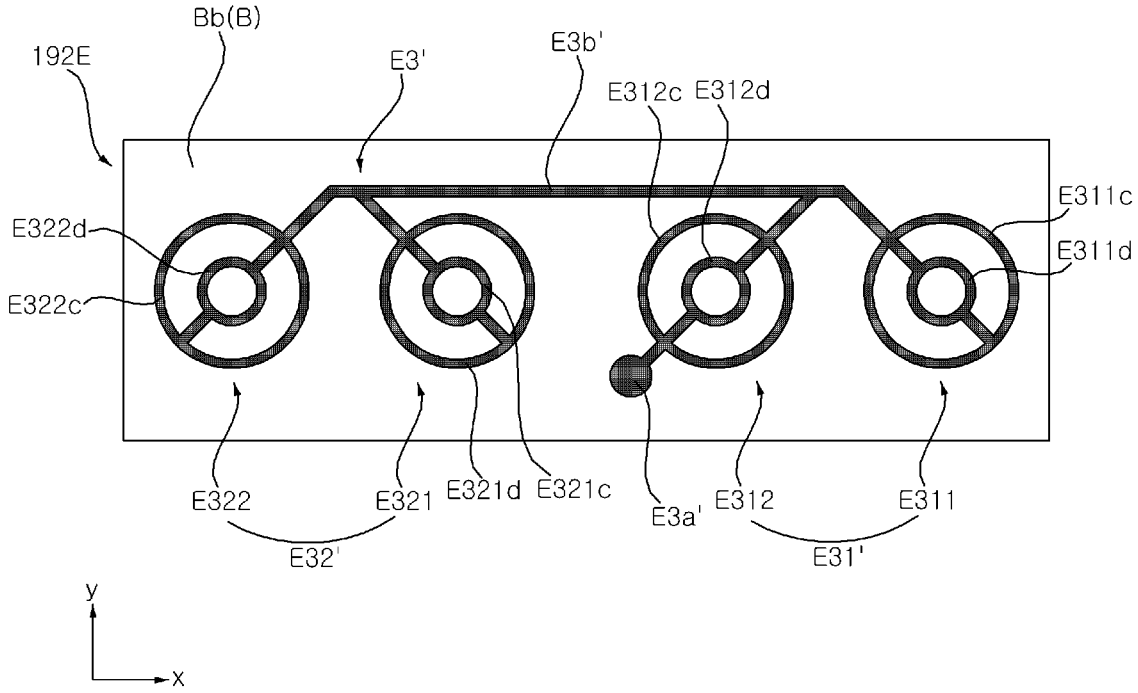

Referring to FIGS. 9 and 10, the ion generator 192E may include a substrate B, a discharge electrode E1', E2', and a ground electrode E3'.

The substrate B may be formed of a dielectric substance. For example, the substrate B may include a ceramic or synthetic resin material. The first surface Bt of the substrate B may face the case hole 192*g* (see FIG. 6), and the second surface Bb of the substrate B may face the voltage generator 192P. The first surface Bt may be referred to as a front surface or an upper surface, and the second surface Bb may be referred to as a rear surface or a lower surface.

The discharge electrode E1', E2' may be formed on the first surface Bt of the substrate B. The discharge electrode E1', E2' may include a metal material such as copper Cu. For example, the discharge electrode E1', E2' may include a first discharge electrode E1' and a second discharge electrode E2' spaced apart from each other in the length direction of the substrate B (see gE). For example, the first discharge electrode E1' and the second discharge electrode E2' may be symmetrical vertically.

The first discharge electrode E1' may include a first point E1*a*', a first line E1*b*', and a pair of first circles E11 and E12.

The first point E1*a*' may be connected to the first wire L1 (see FIG. 6), and may be a portion to which a voltage of the voltage generator 192P (see FIG. 6) is applied. The first point E1*a*' may be referred to as a first terminal.

The first line E1*b*' may connect the first point E1*a*' and the pair of first circles E11 and E2.

The pair of first circles E11 and E12 may be spaced apart from each other in the length direction of the substrate B.

The pair of first circles E11 and E12 may have a shape corresponding to each other. For example, any one of the pair of first circles E11 and E12 may have a shape which is the shape of the other one that is rotated counterclockwise or clockwise by 90 degrees. In this case, the description of any one of the pair of first circles E11 and E12 may be identically applied to the other one. In addition, the first circle E11, which is one of the pair of first circles E11 and E12, may include a first outer circle E11*c* and a first inner circle E11*d*.

The first outer circle E11*c* and the first inner circle E11*d* may be concentric. A diameter of the first outer circle E11*c* may be greater than a diameter of the first inner circle E11*d*. A portion of the aforementioned first line E1*b*' may be connected to the first outer circle E11*c* and the first inner circle E11*d* from between the first outer circle E11*c* and the first inner circle E11*d*.

In addition, the first outer circle E11*c* may include first outer needles E11*cn*. In addition, the first inner circle E11*d* may include first inner needles E11*dn*. For example, the number of the first outer needles E11*cn* may be greater than the number of the first inner needles E11*dn*. Meanwhile, a barrier (not shown) may be located between the first outer circle E11*c* and the first inner circle E11*d*, and may minimize discharge interference between the first outer needles E11*cn* and the first inner needles E11*dn*.

The second discharge electrode E2' may include a second point E2*a*', a second line E2*b*', and a pair of second circles E21 and E22.

The second point E2*a*' may be connected to a second wire L2 (see FIG. 6), and may be a portion to which the voltage of the voltage generator 192P (see FIG. 6) is applied. The second point E2*a*' may be referred to as a second terminal.

The second line E2*b*' may connect the second point E2*a*' and the pair of second circles E21 and E22.

The pair of second circles E21 and E22 may be spaced apart from each other in the length direction of the substrate B. The pair of second circles E21 and E22 may have a shape corresponding to each other. For example, any one of the pair of second circles E21 and E22 may have a shape which is a shape of the other that is rotated counterclockwise or clockwise by 90 degrees. In this case, the description of any one of the pair of second circles E21 and E22 may be identically applied to the other one. In addition, the second circle E21, which is any one of the pair of second circles E21 and E22, may include a second outer circle E21*c* and a second inner circle E21*d*.

The second outer circle E21*c* and the second inner circle E21*d* may be concentric. A diameter of the second outer circle E21*c* may be greater than a diameter of the second inner circle E21*d*. A portion of the aforementioned second line E21*b* may be connected to the second outer circle E21*c* and the second inner circle E21*d* from between the second outer circle E21*c* and the second inner circle E21*d*.

In addition, the second outer circle E21*c* may include second outer needles E21*cn*. In addition, the second inner circle E21*d* may include second inner needles E21*dn*. For example, the number of the second outer needles E21*cn* may be greater than the number of the second inner needles E21*dn*. Meanwhile, a barrier (no reference numeral) may be located between the second outer circle E21*c* and the second inner circle E21*d*, and may minimize discharge interference between the second outer needle E21*cn* and the second inner needle E21*dn*.

A ground electrode E3' may be formed on the second surface Bb of the substrate B. The ground electrode E3' may include a metal material such as copper Cu. For example, the ground electrode E3' may include a ground point E3*a*', a connector E3*b*', a first ground electrode E31', and a second ground electrode E32'. The ground point E3*a*' may be connected to a wire L0 (see FIG. 6). The connector E3*b*' may connect the ground point E3*a*' with the first and second ground electrodes E31' and E32'.

In addition, in a thickness direction of the substrate B, the first ground electrode E31' may be aligned with the first discharge electrode E1'. The first ground electrode E311, E312 may have a shape corresponding to a pair of first circles E11 and E12.

In addition, in the thickness direction of the substrate B, the second ground electrode E32' may be aligned with the second discharge electrode E2'. The second ground electrode E321, E322 may have a shape corresponding to a pair of second circles E21 and E22.

Accordingly, when a high voltage is applied to the discharge electrodes E1' and E2' by the voltage generator 192P, the discharge electrodes E1' and E2' may generate a negative ion and/or a positive ion. That is, the first discharge electrode E1' may be a negative ion discharge electrode that generates a negative ion or a positive ion discharge electrode that generates a positive ion. In addition, the second discharge electrode E2' may be a negative ion discharge electrode that generates a negative ion or a positive ion discharge electrode that generates a positive ion.

Figure 11:
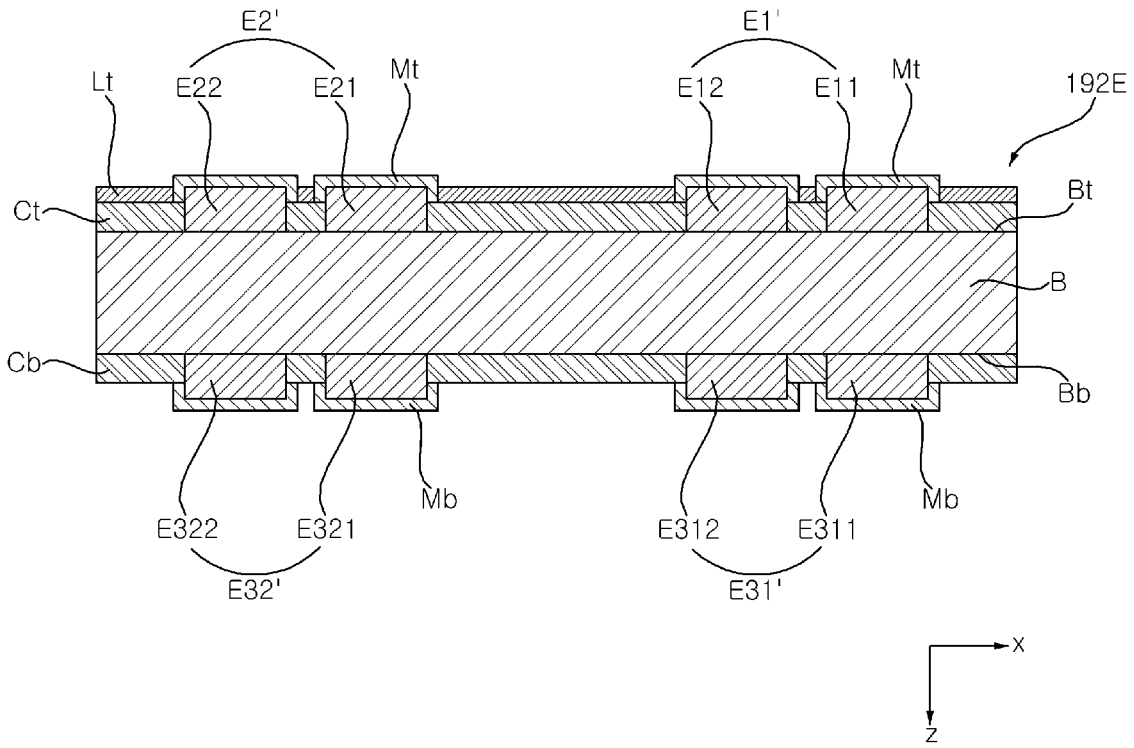
FIG. 11 is a cross-sectional view of an ion generating device according to an embodiment of the present disclosure.

Referring to FIG. 11, a first protection layer Ct may be formed on the first surface Bt of the substrate B, and may be located around the discharge electrodes E1' and E2' or the discharge electrodes E1 and E2 (see FIG. 7). A second protection layer Cb may be formed on the second surface Bb of the substrate B, and may be located around the ground electrode E31', E32' or the ground electrode E31, E32 (see FIG. 8).

A first coating layer Mt may be formed on the surface of the discharge electrodes E1' and E2' or the discharge electrodes E1 and E2 (see FIG. 7). A second coating layer Mb may be formed on the surface of the ground electrode E31', E32' or the ground electrode E31, E32 (see FIG. 8). For example, the first coating layer Mt and the second coating layer Mb may include a metal material such as gold Au.

Meanwhile, a photocatalyst Lt may be coated on the surface of the first protection layer Ct. The photocatalyst Lt may include tungsten oxide, titanium oxide, zinc oxide, or zirconium oxide. The photocatalyst Lt may be activated by light. For example, the photocatalyst Lt may be activated by light in an ultraviolet wavelength band.

Accordingly, as a high voltage is applied to the discharge electrodes E1' and E2' or the discharge electrodes E1 and E2 (see FIG. 7), a plasma discharge may be generated, and a ultraviolet light (UV) that is generated due to the plasma discharge may activate the photocatalyst Lt. In this case, radical and ion may be generated, and oxidation of organic matter may be promoted to help sterilization and deodorization.

Figure 12:
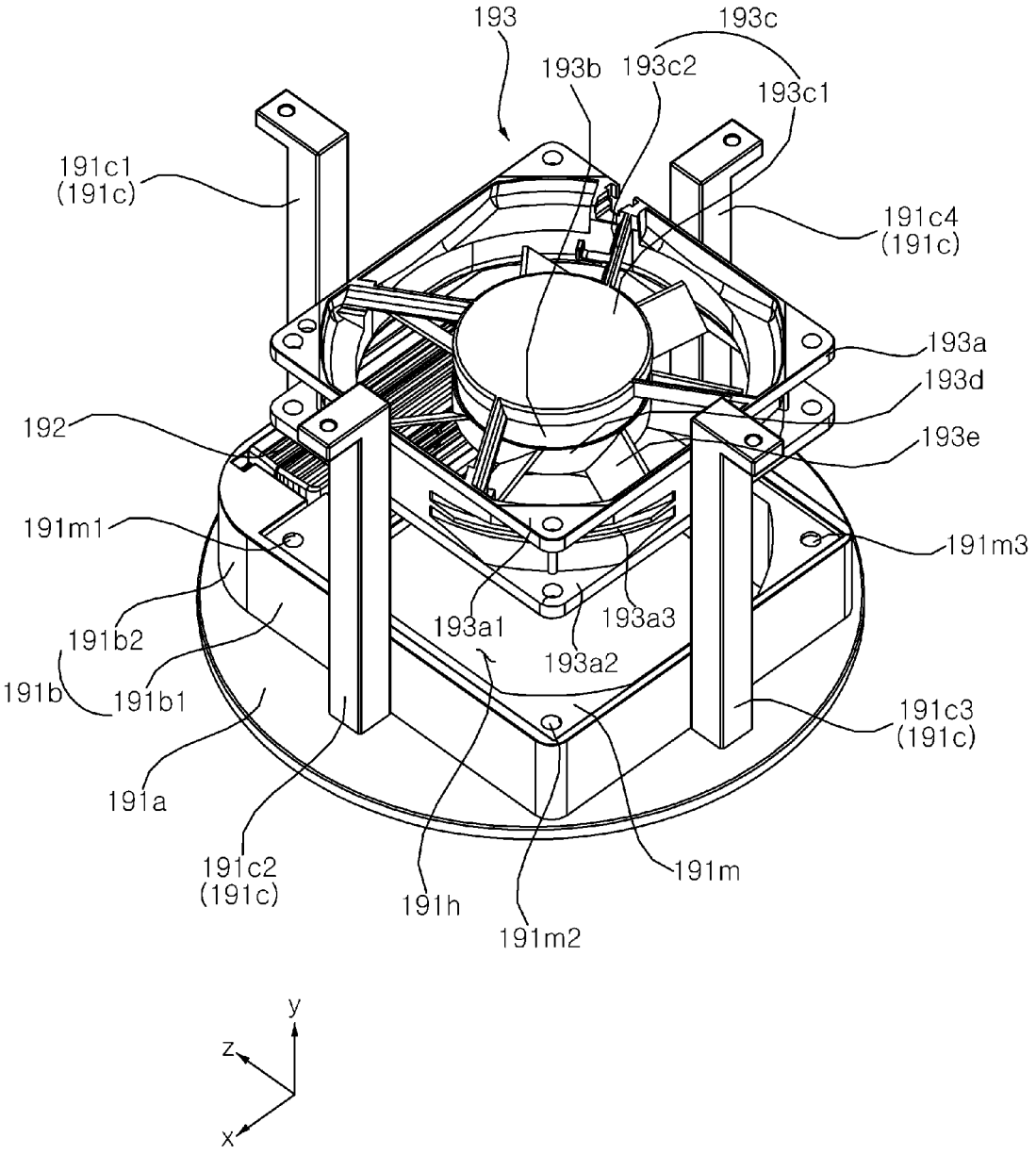
FIG. 12 is a view for explaining a fan of an ion generating device according to an embodiment of the present disclosure.

Referring to FIG. 12, the fan 193 may include a fan housing 193*a*, a motor 193*b*, a holder 193*c*, a hub 193*d*, and a plurality of blades 193*e*.

The fan housing 193*a* may be opened vertically, and the remaining components of the fan 193 excluding the fan housing 193*a* may be located in the internal space of the fan housing 193*a*.

For example, the fan housing 193*a* may include a first flat plate portion 193*a*1, a second flat plate portion 193*a*2, and a pillar portion 193*a*3 formed as one body. The first flat plate portion 193*a*1 may form an upper surface of the fan housing 193*a*, and the second flat plate portion 193*a*2 may form a lower surface of the fan housing 193*a*. The pillar portion 193*a*3 may be located between the first flat plate portion 193*a*1 and the second flat plate portion 193*a*2, and may have a flat cylinder shape. The inner space of the fan housing 193*a* may be formed to vertically penetrate the first flat plate portion 193*a*1, the pillar portion 193*a*3, and the second flat plate portion 193*a*2. The inner space may communicate with the discharge hole 191*h*.

The motor 193*b* may provide a rotational force. The motor 193*b* may be an axial-flow fan motor. The motor 193*b* may be located in the inner space of the fan housing 193*a*. A rotation shaft 193*b*1 (see FIG. 13) of the motor 193*b* may extend downward from the motor 193*b*. The rotation shaft 193*b*1 of the motor 193*b* may be coaxial with the central shaft of the fan 193.

One side of the holder 193*c* may be fixed to the upper surface of the motor 193*b*, and the other side of the holder 193*c* may be fixed to the inner side of the fan housing 193*a*.

For example, the holder 193*c* may include a cap 193*c*1 and arms 193*c*2. The cap 193*c*1 may cover the upper surface of the motor 193*b*, and the motor 193*b* may be fixed thereto. The arms 193*c*2 may protrude from the side surface of the cap 193*c*1 to the inner side of the fan housing 193*a*, and may be fixed to the inner side of the fan housing 193*a*. These arms 193*c*2 may be spaced apart from each other in the circumferential direction of the cap 193*c*1, and it is possible to minimize the flow resistance of the air passing around the arms 193*c*2.

The hub 193*d* may be located in the lower side of the motor 193*b*, and may be fixed to the rotation shaft 193*b*1 (see FIG. 13) of the motor 193*b*. The hub 193*b* may have a cup shape as a whole.

The plurality of blades 193*e* may be formed on the outer circumferential surface of the hub 193*d*, and may be spaced apart from each other in the circumferential direction of the hub 193*d*. The distal end of the blade 193*e* may be spaced apart from the inner side of the fan housing 193*a*.

Figure 13:
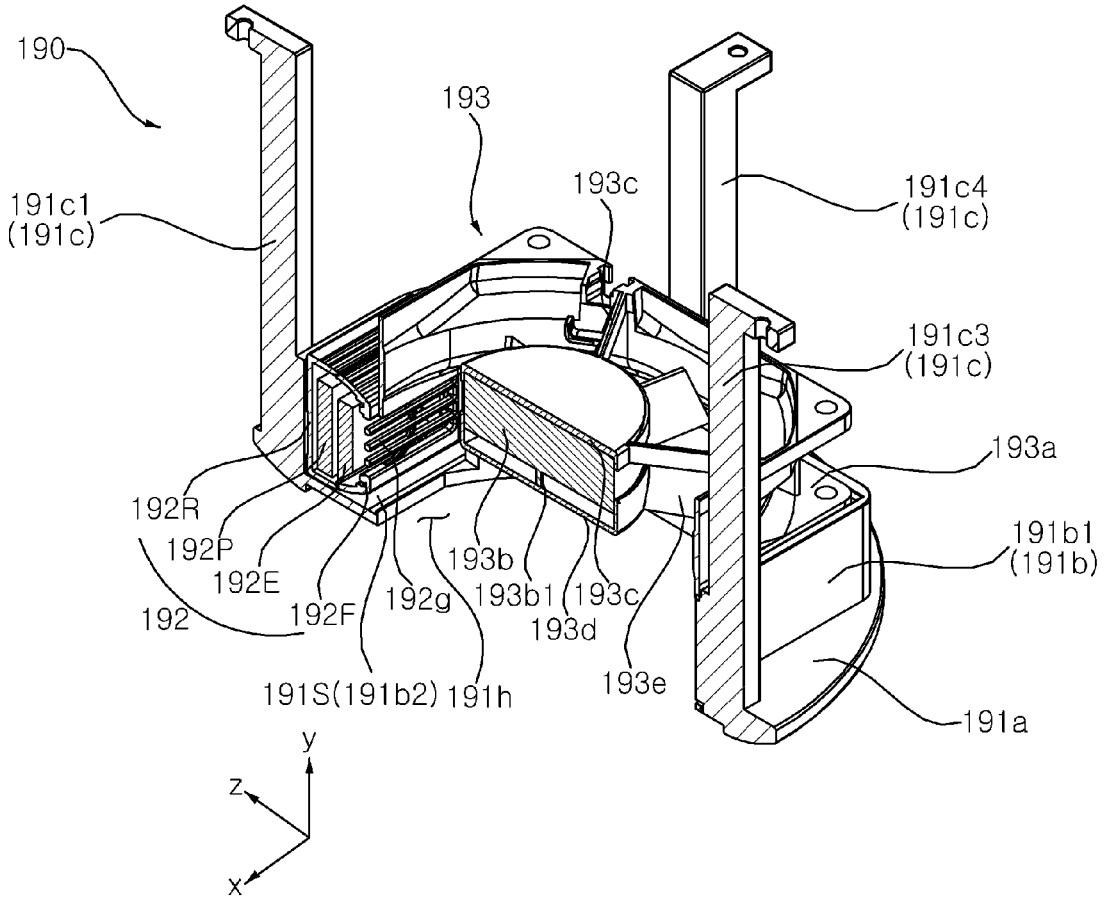
FIG. 13 is a view for explaining an ion generating device including a single ionizer according to an example of the present disclosure.

Accordingly, when the motor 193*b* is driven, the plurality of blades 193*e* may rotate in the rotational direction of the rotation shaft 193*b*1 (see FIG. 13). At this time, the air located in the upper side of the fan 193 may be introduced in the shaft direction of the fan 193, and may be discharged to the lower side of the fan 193.

Referring to FIGS. 12 and 13, a groove 191*m* may be formed while being depressed downward from the upper surface of the seating portion 191*b*1, and may extend along the circumference of the seating portion 191*b*1. The plurality of fastening holes 191*m*1, 191*m*2, 191*m*3, and 191*m*4 (see FIGS. 5 and 12) may be formed on the groove 191*m*, and may be adjacent to corners of the groove 191*m*. In the up-down direction, the groove 191*m* may be aligned with the lower surface of the second flat plate portion 193*a*2.

Accordingly, the second flat plate portion 193*a*2 of the fan housing 193*a* may be seated in the groove 191*m*. Each of the plurality of fastening members such as a screw or a long bolt may penetrate the first flat plate portion 193*a*1 and the second flat plate portion 193*a*2, and may be fastened to each of a plurality of fastening holes 191*m*1, 191*m*2, 191*m*3, and 191*m*4.

In this case, in the horizontal direction, the ionizer 192 coupled to the receiving portion 191*b*2 may be located outside the fan 193 coupled to the body 191*b*1. In addition, in the vertical direction, the case hole 192*g* of the ionizer 192 may be located in the lower side of the fan 193.

Accordingly, the ions generated by the ionizer 192 may be carried by the airflow of the fan 193 and flow to the lower side of the discharge hole 191*h*. That is, the ions generated by the ionizer 192 may be distributed over an entire sterilization target space (particularly, a part far away from or cornered from the ion generating device) by the fan 193.

Figure 14:
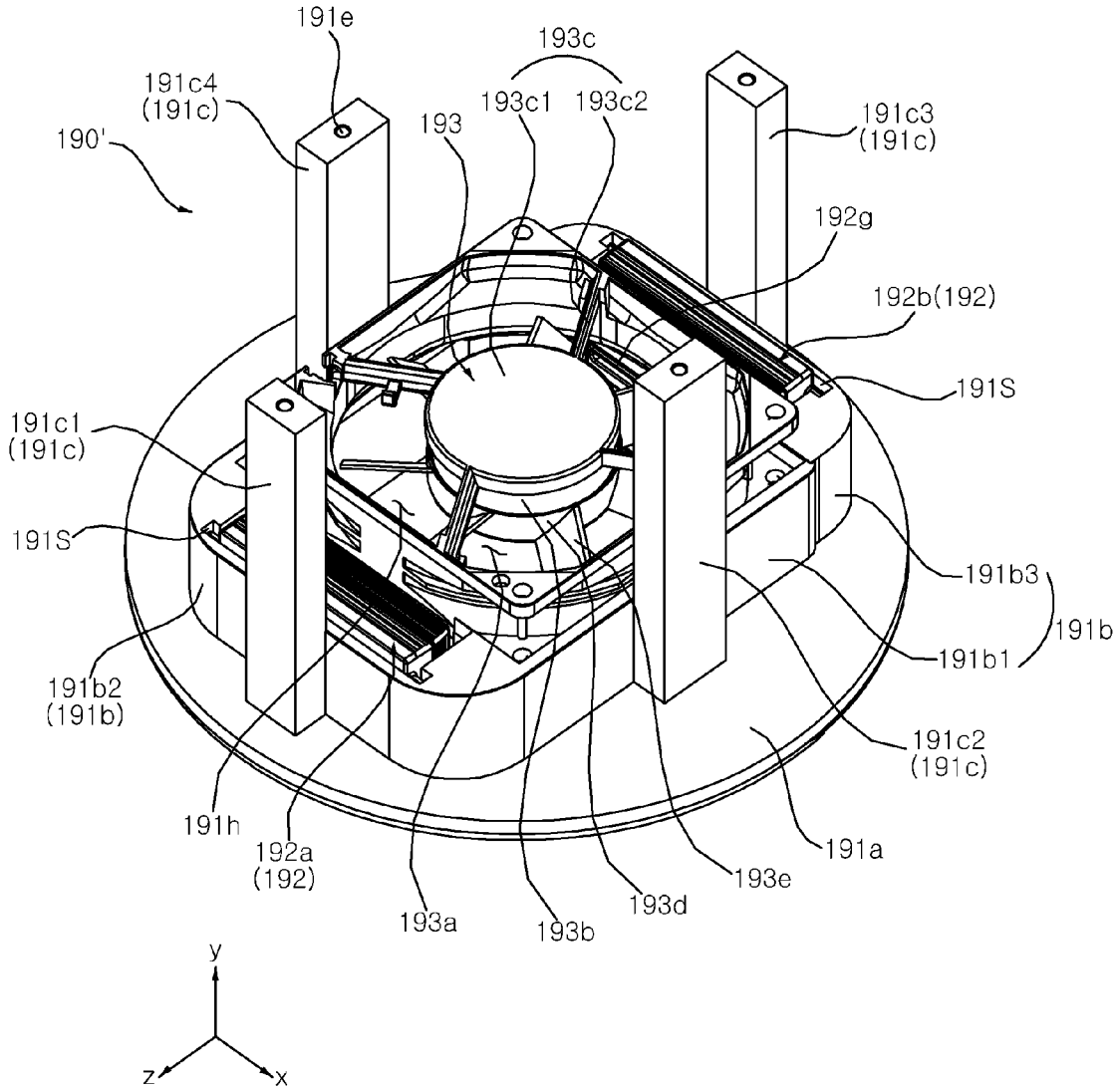
FIG. 14 is a view for explaining an ion generating device including at least two ionizers according to another example of the present disclosure.

Referring to FIG. 14, the ion generating device 190' may include at least two or more ionizers 192*a* and 192*b*. The description of the ionizer 192 described above with reference to FIG. 13 and the like may be identically applied to at least two or more ionizers 192*a* and 192*b*.

For example, the ion generating device 190' may include a first ionizer 192*a* and a second ionizer 192*b* that face each other with respect to the fan 193. The first ionizer 192*a* may be inserted into the slot 191S of the receiving portion 191*b*2 provided in the first side BS1 (see FIG. 5) of the seating portion 191*b*1. The second ionizer 192*b* may be inserted into the slot 191S of the receiving portion 191*b*3 provided in the third side BS3 (see FIG. 5) of the seating portion 191*b*1.

In addition, the second ionizer 192*b* may be symmetrical with the first ionizer 192*a* with respect to the fan 193. That is, the case hole 192*g* of the first ionizer 192*a* and the case hole 192*g* of the second ionizer 192*b* may face the discharge hole 191*h*. Accordingly, the ion supply amount of the ion generating device 190' may increase.

Figure 15:
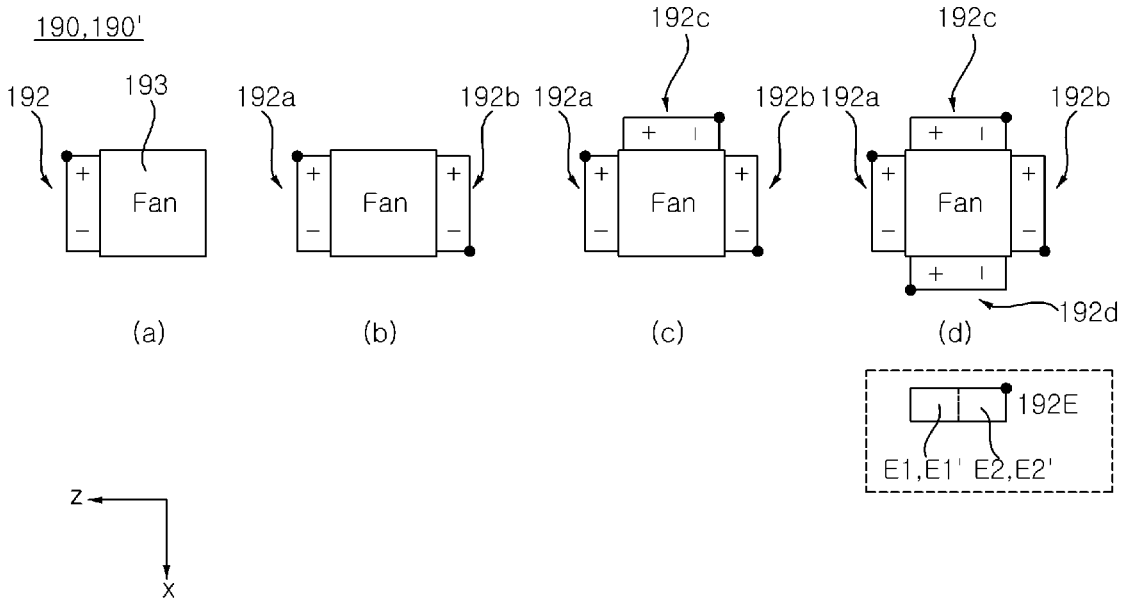
FIG. 15 (*a*) to (*d*) are views for explaining various examples of an ionizer that generates positive and negative ions as a bipolar ionizer according to an example of the present disclosure.
Figure 16:
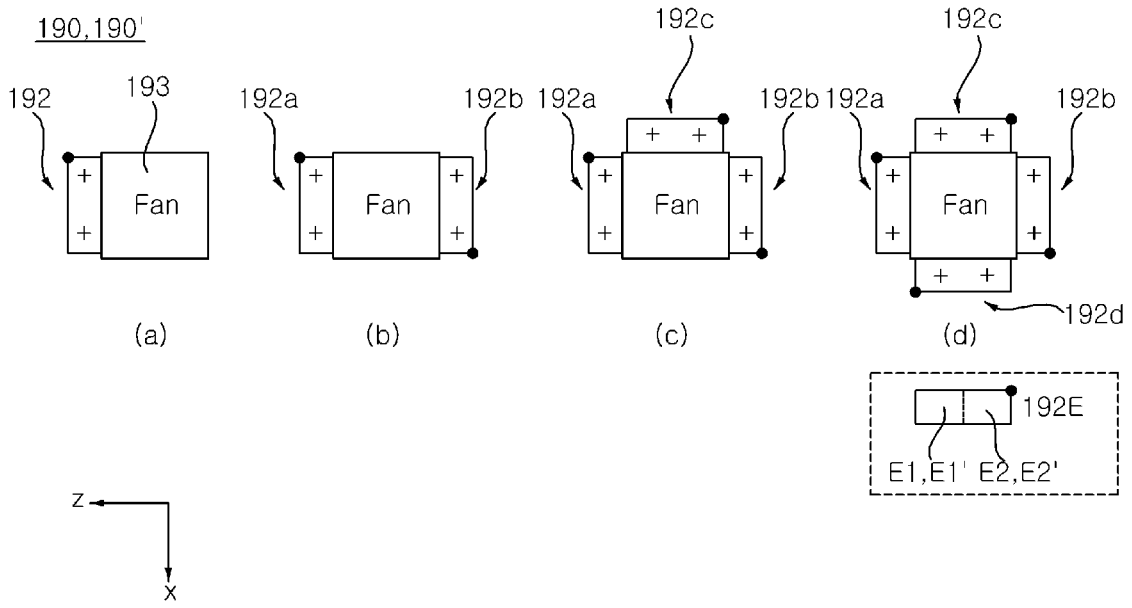
FIG. 16 (*a*) to (*d*) are views for explaining various examples of an ionizer generating positive ions as a unipolar ionizer according to another example of the present disclosure.
Figure 17:
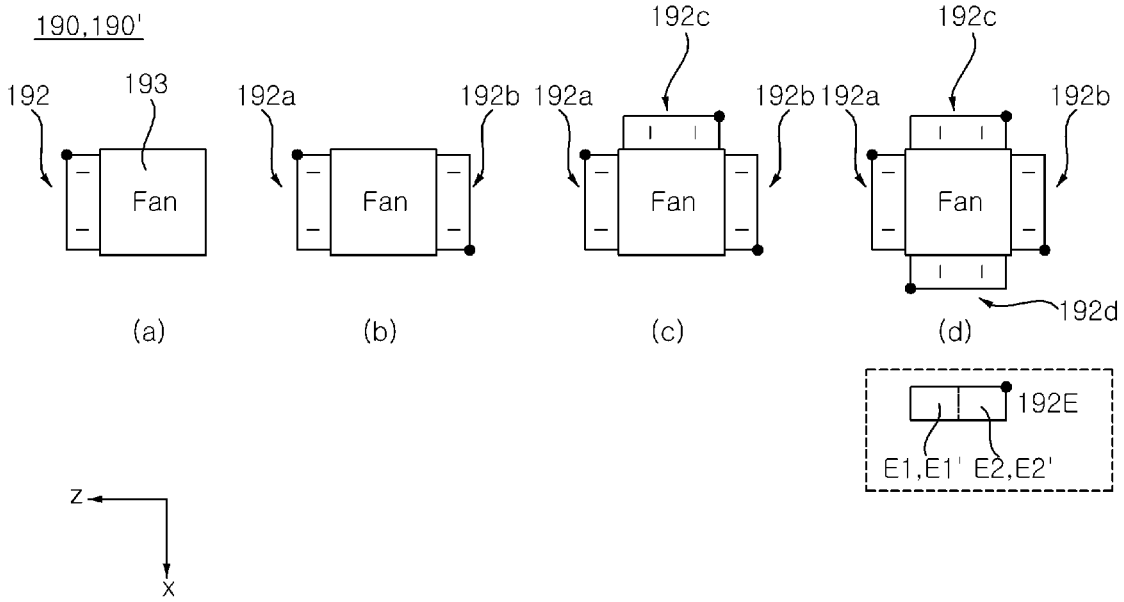
FIG. 17 (*a*) to (*d*) are views for explaining various examples of an ionizer that generates negative ions as a unipolar ionizer according to still another example of the present disclosure.

Referring to FIGS. 15 to 17, the ion generating device 190 may include one ionizer 192. Alternatively, the ion generating device 190' may include two to four ionizers 192*a*, 192*b*, 192*c*, and 192*d*. In the ionizers 192*a*, 192*b*, 192*c*, and 192*d*, each case hole 192*g* (see FIGS. 13 and 14) may face the discharge hole 191*h*.

Referring to FIG. 15, the ionizer may be a bipolar ionizer. That is, the first discharge electrode E1, E1' and the second discharge electrode E2, E2' of the ion generator 192E may generate ions having a different polarity. When the first discharge electrode E1, E1' generates positive ions, the second discharge electrode E2, E2' may generate negative ions. When the first discharge electrode E1, E1' generates negative ions, the second discharge electrode E2, E2' may generate positive ions. Accordingly, the ionizer may generate positive ions and negative ions.

Referring to FIG. 15A, the ion generating device 190 may include one ionizer 192. The ionizer 192 may be located outside the first side BS1 (see FIG. 5) of the seating portion 191*b*1. For example, the first discharge electrode E1, E1' may generate negative ions, and the second discharge electrode E2, E2' may generate positive ions.

Referring to FIG. 15B, the ion generating device 190' may include a first ionizer 192*a* and a second ionizer 192*b*. The first ionizer 192*a* may be located outside the first side BS1 (see FIG. 5) of the seating portion 191*b*1. The second ionizer 192*b* may be located outside the third side BS3 (see FIG. 5) of the seating portion 191*b*1. For example, the first discharge electrode E1, E1' of the first ionizer 192*a* may generate negative ions, and the second discharge electrode E2, E2' may generate positive ions.

In this case, the first discharge electrode E1, E1' of the second ionizer 192*b* may face the second discharge electrode E2, E2' of the first ionizer 192*a* and generate positive ions. In addition, the second discharge electrode E2, E2' of the second ionizer 192*b* may face the first discharge electrode E1, E1' of the first ionizer 192*a*, and may generate negative ions. Accordingly, neutralization between the ions generated by the first ionizer 192*a* and the ions generated by the second ionizer 192*b* may be minimized.

Referring to FIG. 15C, the ion generating device 190' may include a first ionizer 192*a*, a second ionizer 192*b*, and a third ionizer 192*c*. The third ionizer 192*c* may be located outside the fourth side BS4 (see FIG. 5) of the seating portion 191*b*1. For example, the first discharge electrode E1, E1' of the third ionizer 192*c* may generate positive ions, and the second discharge electrode E2, E2' may generate negative ions.

Referring to FIG. 15D, the ion generating device 190' may include a first ionizer 192*a*, a second ionizer 192*b*, a third ionizer 192*c*, and a fourth ionizer 192*d*. The fourth ionizer 192*d* may be located outside the second side BS2 (see FIG. 5) of the seating portion 191*b*1. For example, the first discharge electrode E1, E1' of the third ionizer 192*c* may generate positive ions, and the second discharge electrode E2, E2' may generate negative ions.

In this case, the first discharge electrode E1, E1' of the fourth ionizer 192*d* may face the second discharge electrode E2, E2' of the third ionizer 192*c*, and generate negative ions. In addition, the second discharge electrode E2, E2' of the fourth ionizer 192*d* may face the first discharge electrode E1, E1' of the third ionizer 192*c*, and may generate positive ions. Accordingly, neutralization between ions generated by the first to fourth ionizers 192*a*, 192*b*, 192*c*, and 192*d* may be minimized.

Referring to FIGS. 16 and 17, the ionizer may be a unipolar ionizer. That is, the first discharge electrode E1, E1' and the second discharge electrode E2, E2' of the ion generator 192E may generate ions having the same polarity.

Referring to FIG. 16, for example, the first discharge electrode E1, E1' and the second discharge electrode E2, E2' may generate positive ions.

As another example with reference to FIG. 17, the first discharge electrode E1, E1' and the second discharge electrode E2, E2' may generate negative ions.

Accordingly, the ionizer may generate positive ions or negative ions. In addition, it is possible to prevent neutralization between ions generated by the ionizers 192*a*, 192*b*, 192*c*, and 192*d*.

Figure 18:
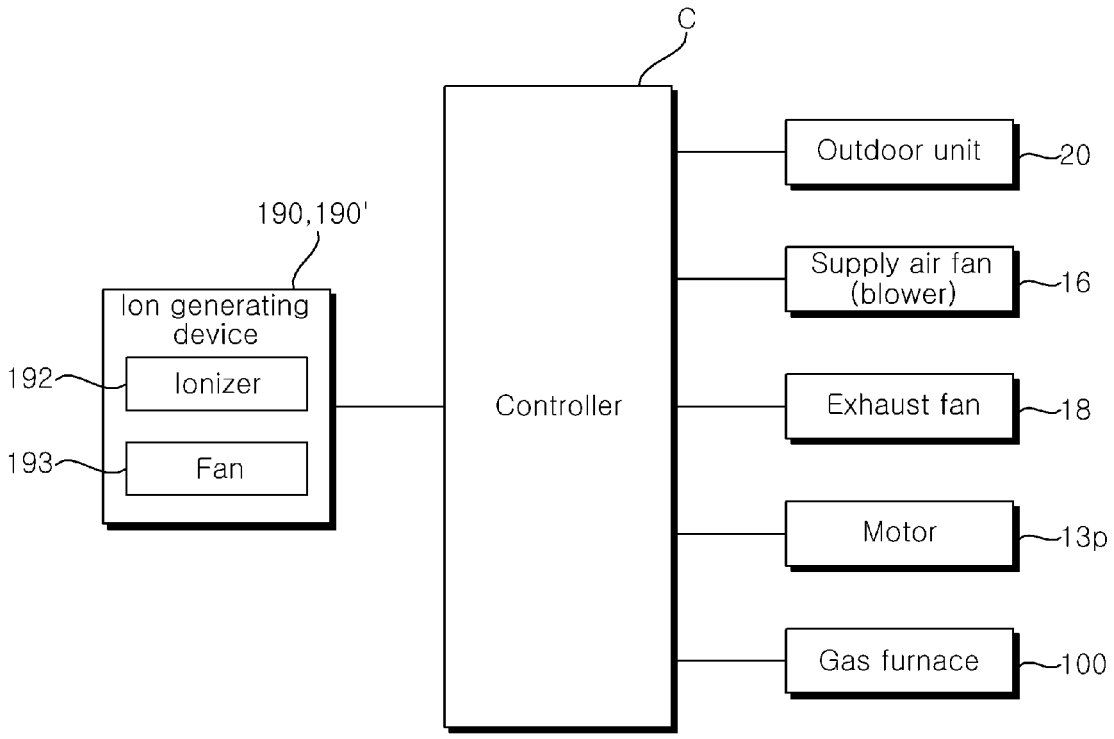
FIGS. 18 and 19 are a control configuration diagram of an air conditioner and a flowchart of control method according to an embodiment of the present disclosure.

Referring to FIG. 18, a controller C of the air conditioner may be electrically connected to components of the air conditioner.

The controller C may be electrically connected to the outdoor unit 20, and may control the operation of a compressor of the outdoor unit 20. The controller C may be electrically connected to the blower 16 and the exhaust fan 18, and may control the operations of the blower 16 and the exhaust fan 18. The controller C may be electrically connected to the motor 13*p*, and may control the operation of the recovery wheel 13 through the motor 13*p*. The controller C may be electrically connected to the gas furnace 100, and may control the operation of the gas furnace 100.

In addition, the controller C may control the operations of the ionizer 192 and the fan 193 of the ion generating device 190, 190'.

Figure 19:
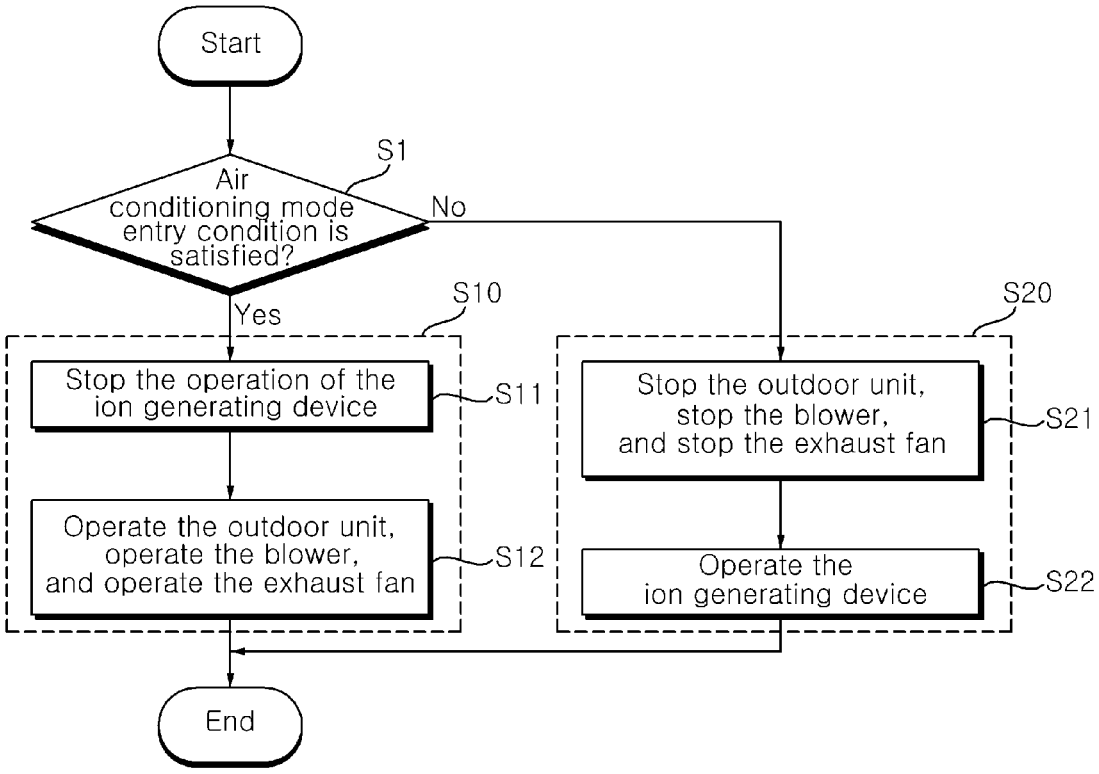

Referring to FIGS. 18 and 19, the controller C may determine whether an air conditioning mode entry condition is satisfied (S1). For example, the air conditioning mode entry condition may be satisfied according to a user's desire. For another example, the air conditioning mode entry condition may be satisfied when a difference between a desired indoor temperature input to an indoor thermostat and a current indoor temperature detected by a thermocouple of the thermostat exceeds a reference range.

When the air conditioning mode entry condition is satisfied (S1: Yes), the controller C may perform an air conditioning operation through the air conditioner 1 (see FIG. 1) (S10). Specifically, the controller C may stop the operation of the ion generating device 190, 190' (S11), and operate the outdoor unit 20, the blower 16, and the exhaust fan 18 (S12). In addition, if indoor heating is required, the controller C may also operate the gas furnace 100.

Accordingly, the air conditioner 1 may heat and cool an indoor space, or ventilate the indoor space.

When the air conditioning mode entry condition is satisfied (S1: No), the controller C may perform a sterilization operation through the air conditioner 1 (see FIG. 1) (S20). Specifically, the controller C may stop the operations of the outdoor unit 20, the blower 16, and the exhaust fan 18 (S21). In addition, when the gas furnace 100 is in operation, the controller C may also stop the operation of the gas furnace 100. Then, the controller C may operate the ion generating device 190, 190' (S22).

Accordingly, the air conditioner 1 can sterilize the inside of the ventilation device 10 (see FIG. 1).

Referring back to FIG. 1, the ion generating device 190 may include a first ion generating device 190*a* and a second ion generating device 190*b*. The first ion generating device 190*a* may be located between the recovery wheel 13 and the heat exchanger 14, and may be coupled to the inner side of the top part 10T which is a portion forming the first long side LS1 of the housing 10H. The second ion generating device 190*b* may be located between the heat exchanger 14 and the reheater 15, and may be coupled to the inner side of the top part 10T which is a portion forming the first long side LS1 of the housing 10H.

Meanwhile, in some embodiments, any one of the first ion generating device 190*a* and the second ion generating device 190*b* may be omitted. At this time, considering that a space in which the first ion generating device 190*a* is installed is located upstream of a space in which the second ion generating device 190*b* is installed, preferably, the first ion generating device 190*a* may be provided in the ventilation device 10.

Figure 20:
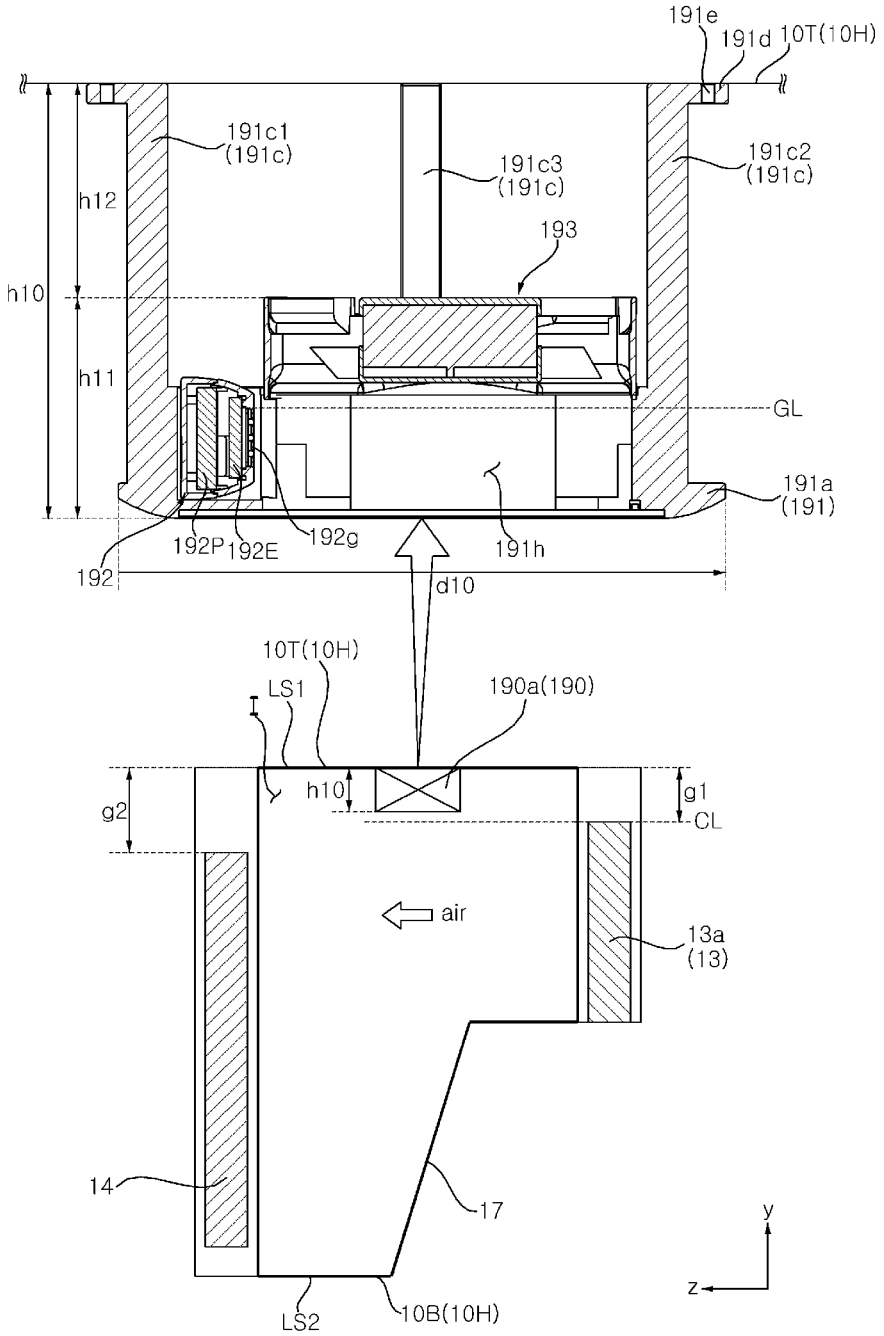
FIG. 20 is a view for explaining an ion generating device installed in a first space of an air conditioner according to an embodiment of the present disclosure.

Referring to FIGS. 1 and 20, the first space I may be a portion of the internal space of the housing 10H, and may be a space formed between the first portion 13*a* of the recovery wheel 13 and the heat exchanger 14. A portion of the top part 10T of the housing 10H, a portion of the bottom part 10B of the housing 10H, and the damper mount 17 may define a portion of the boundary of the first space I.

The upper end of the first portion 13*a* of the recovery wheel 13 may be spaced downward from the top part 10T. The upper end of the heat exchanger 14 may be spaced downward from the top part 10T. In the up-down direction, a first gap g1 between the top part 10T and the upper end of the first portion 13*a* may be smaller than or equal to a second gap g2 between the top part 10T and the upper end of the heat exchanger 14.

The first ion generating device 190*a* may be coupled to the inner side of the top part 10T from between the first portion 13*a* and the heat exchanger 14. For example, the volume of the first ion generating device 190*a* may be 0.5% or less of the volume of the first space I. For example, the height h10 of the first ion generating device 190*a* may be smaller than the first gap g1. That is, the lower end of the first ion generating device 190*a* may be located in the upper side of the upper end of the first portion 13*a* and the upper end of the heat exchanger 14. As another example, the height h10 of the first ion generating device 190*a* may be equal to or slightly greater than the first gap g1. That is, the lower end of the first ion generating device 190*a* may be located parallel to or slightly lower than the upper end of the first portion 13*a*.

Accordingly, the first ion generating device 190*a* may be spaced apart from the main airflow of air that sequentially passes through the first portion 13*a* and the heat exchanger 14 by the blower 16. In other words, in the air conditioning mode, an increase in air flow resistance by the first ion generating device 190*a* can be minimized. In addition, particularly during a cooling operation, the first space I may be a space having a low temperature and low humidity, and may be a good environment for microorganisms or bacteria to grow. That is, the first ion generating device 190*a* may remove microorganisms or bacteria inhabiting the first space I by providing ions to the first space I.

Meanwhile, the height h10 of the first ion generating device 190*a* may be the sum of a first height h11 and a second height h12. The first height h11 may be a distance between the lower end of the base 191*a* and the upper end of the fan 193. The second height h12 may be a distance between the upper end of the fan 193 and the upper end of the foot 191*d*. In other words, the upper end of the fan 193 may be spaced downward from the top part 10T by the second height h12.

Accordingly, air may be introduced in the shaft direction of the fan 193 through between the top part 10T and the upper end of the fan 193.

Figure 21:
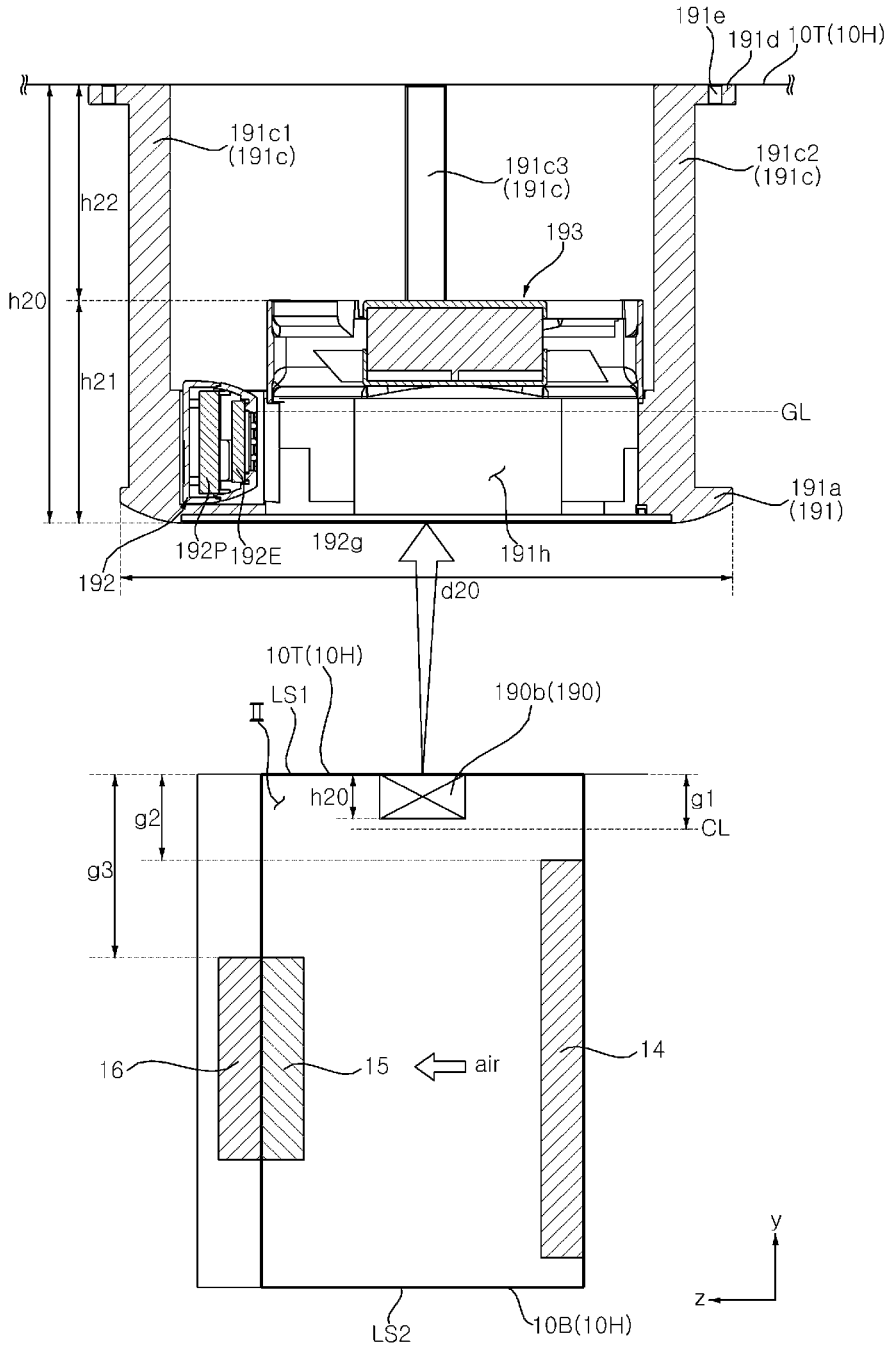
FIG. 21 is a view for explaining an ion generating device installed in a second space of an air conditioner according to an embodiment of the present disclosure.

Referring to FIGS. 1 and 21, the second space II may be a portion of the inner space of the housing 10H, and may be a space in which the heat exchanger 14 and the reheater 15 are disposed. A portion of the top part 10T of the housing 10H and a portion of the bottom part 10B of the housing 10H may define a portion of a boundary of the second space II.

The reheater 15 may be spaced downward from the top part 10T. In the up-down direction, a third gap g3 between the top part 10T and the upper end of the reheater 15 may be greater than the second gap g2 between the top part 10T and the upper end of the heat exchanger 14.

The second ion generating device 190*b* may be coupled to the inner side of the top part 10T from between the heat exchanger 14 and the reheater 15. For example, the volume of the second ion generating device 190*b* may be 0.5% or less of the volume of the second space II. For example, the height h20 of the second ion generating device 190*b* may be smaller than the second gap g2. That is, the lower end of the second ion generating device 190*b* may be located in the upper side of the upper end of the heat exchanger 14 and the upper end of the reheater 15. As another example, the height h20 of the second ion generating device 190*b* may be equal to or slightly larger than the second gap g2. That is, the lower end of the second ion generating device 190*b* may be located parallel to or slightly lower than the upper end of the heat exchanger 14.

Accordingly, the second ion generating device 190*b* may be spaced apart from the main airflow of air that sequentially passes through the heat exchanger 14 and the reheater 15 by the blower 16. In other words, in the air conditioning mode, an increase in air flow resistance by the second ion generating device 190*b* can be minimized. In addition, particularly during a cooling operation, the second space II may be a space having a fairly low temperature and a fairly low humidity, and may be a good environment for microorganisms or bacteria to grow. That is, the second ion generating device 190*b* may remove microorganisms or bacteria inhabiting the second space II by providing ions to the second space II.

Meanwhile, the height h20 of the second ion generating device 190*b* may be the sum of the first height h21 and the second height h22. The first height h21 may be a distance between the lower end of the base 191*a* and the upper end of the fan 193. The second height h22 may be a distance between the upper end of the fan 193 and the upper end of the foot 191*d*. In other words, the upper end of the fan 193 may be spaced downward from the top part 10T by the second height h22.

Accordingly, air may be introduced in the shaft direction of the fan 193 through between the top part 10T and the upper end of the fan 193.

Referring back to FIGS. 20 and 21, the height h10 of the first ion generating device 190*a* and the height h20 of the second ion generating device 190*b* may be the same.

For example, the number of ionizers 192 provided in the first ion generating device 190*a* may be the same as the number of ionizers 192 provided in the second ionizer 190*b*. In this case, the diameter d10 of the base 191*a* of the first ionizer 190*a* may be the same as the diameter d20 of the base 191*a* of the second ionizer 190*b*. The diameter d10 or d20 of the base 191*a* may increase as the number of ionizers 192 provided in the ion generating device 190*a* or 190*b* increases. That is, the diameter (see FIG. 14) of the base 191*a* of the ion generating device 190*a* or 190*b* including two ionizers 192*a* and 192*b* may be larger than the diameter (see FIG. 13) of the base 191*a* of the ion generating device 190*a* or 190*b* including one ionizer 192.

For another example, the number of ionizers 192 provided in the first ion generating device 190*a* may be different from the number of ionizers 192 provided in the second ion generating device 190*b*. In this case, the diameter d10 of the base 191*a* of the first ionizer 190*a* may be different from the diameter d20 of the base 191*a* of the second ionizer 190*b*. Considering that the first space (I) is located upstream of the second space (II), preferably, the number of ionizers 192 provided in the first ion generating device 190*a* may be greater than the number of ionizers 192 provided in the second ion generating device 190*b*.

Figure 22:
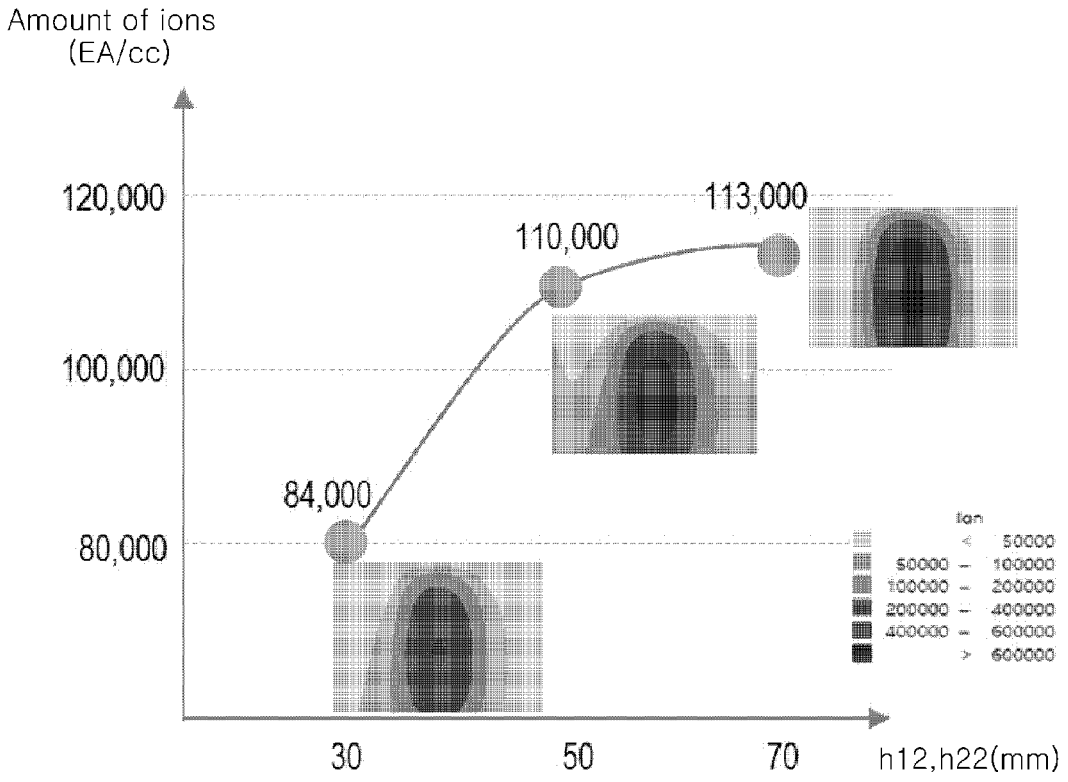
FIG. 22 is a graph for checking a change in the amount of ions according to a distance between a fan and a housing of the ion generating device according to an embodiment of the present disclosure.

Referring to FIG. 22, it can be seen that the amount of ions (EA/cc) generated by the ion generating device 190*a*, 190*b* varies according to the second height h12, h22 described above with reference to FIGS. 20 and 21.

Specifically, when the second height h12, h22 is 30 mm, ions of 84,000 EA/cc may be generated by the ion generating device 190*a*, 190*b*. When the second height h12, h22 is 50 mm, ions of 110,000 EA/cc may be generated in the ion generating device 190*a*, 190*b*. When the second height h12, h22 is 70 mm, 113,000 EA/cc of ions may be generated by the ion generating device 190*a*, 190*b*. That is, as the second height h12, h22 is increased, the amount of ions EA/cc generated by the ion generating device 190*a*, 190*b* may increase, but may be gradually saturated. For example, the second heights h12 and h22 may be 50 mm or more.

Figure 23:
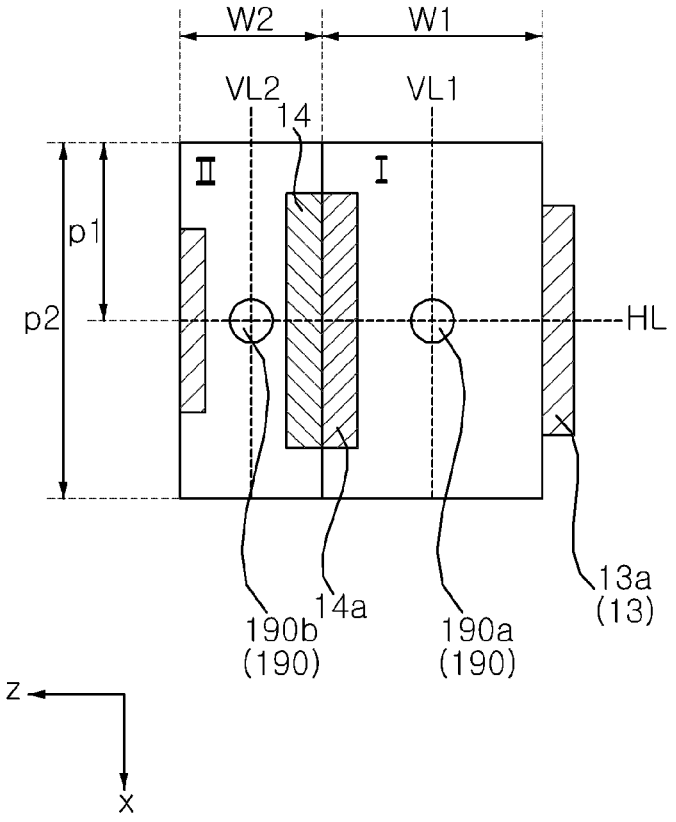
FIGS. 23 to 24B are views for explaining an optimal position of an ion generating device according to an embodiment of the present disclosure.

Referring to FIG. 23, the first space I may be larger than the second space II. In the front-rear direction, the width w1 of the first space I may be greater than the width w2 of the second space II. In the left-right direction, the length p2 of the first space I may be equal to the length p2 of the second space II.

The virtual center line HL may pass through a center (see P1) of the top part 10T (see FIG. 20) defining the upper boundary of the first space I and a center (see P1) of the top part 10T (see FIG. 21), defining the upper boundary of the second space II, and may extend in the front-rear direction.

The virtual first line VL1 may pass through the center of the top part 10T (see FIG. 18) defining the upper boundary of the first space I, and may extend in the left-right direction.

The virtual second line VL2 may pass through the center of the top part 10T (see FIG. 19) defining the upper boundary of the second space II, and may extend in the left-right direction.

That is, the center line HL and the first line VL1 may intersect at the center of the top part 10T defining the upper boundary of the first space I. Moreover, the center line HL and the second line VL2 may intersect at the center of the top part 10T defining the upper boundary of the second space II.

Referring to FIGS. 23 and 24, it can be seen that the ion concentration EA/cc of the bottom surface varies according to the positions of the first ion generating device 190*a* and the second ion generating device 190*b*. For example, the ion concentration EA/cc of the bottom surface of the first space I may be measured at a point DP on the bottom part 10B defining the lower boundary of the first space I.

Figure 24A:
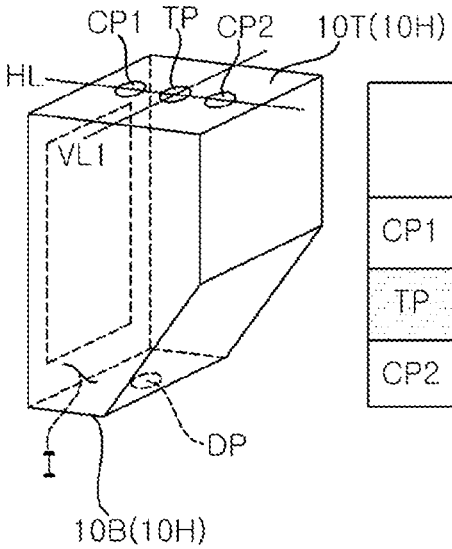

Referring to FIG. 24A, for example, the ion concentration of the bottom surface according to the position of the first ion generating device 190*a* on the center line HL may be checked. A target point TP may be located at an intersecting point of the center line HL and the first line VL1. A first comparison point CP1 and a second comparison point CP2 may be located on the center line HL and may face each other with respect to the target point TP. When the first ion generating device 190*a* is disposed at the target point TP, it can be seen that the ion concentration of the bottom surface is measured to be high, in comparison with a case where the first ion generating device 190*a* is disposed at the first comparison point CP1 or the second comparison point CP2.

Figure 24B:
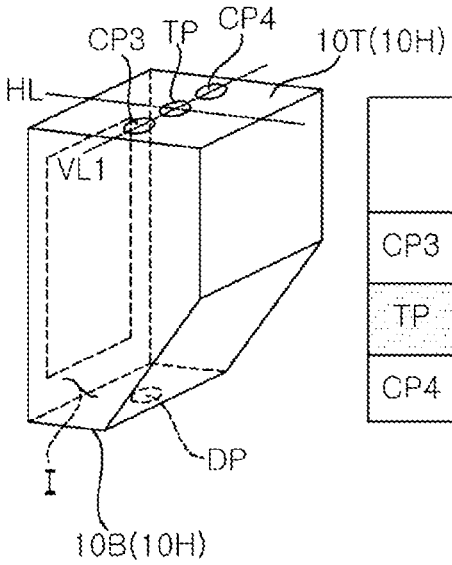

Referring to FIG. 24B, for example, the ion concentration of the bottom surface according to the position of the first ion generating device 190*a* on the first line VL1 may be checked. The target point TP may be located at an intersecting point of the center line HL and the first line VL1. A third comparison point CP3 and a fourth comparison point CP4 may be located on the first line VL1 and may face each other with respect to the target point TP. When the first ion generating device 190*a* is disposed at the target point TP, it can be seen that the ion concentration of the bottom surface is measured to be high in comparison with a case where the first ion generating device 190*a* is disposed at the third comparison point CP3 or the fourth comparison point CP4.

Accordingly, preferably, the first ion generating device 190*a* may be disposed at the center of the top part 10T (see FIG. 20) defining the upper boundary of the first space I. Similarly, preferably, the second ion generating device 190*b* may be disposed at the center of the top part 10T (see FIG. 21) defining the upper boundary of the second space II.

Figure 25:
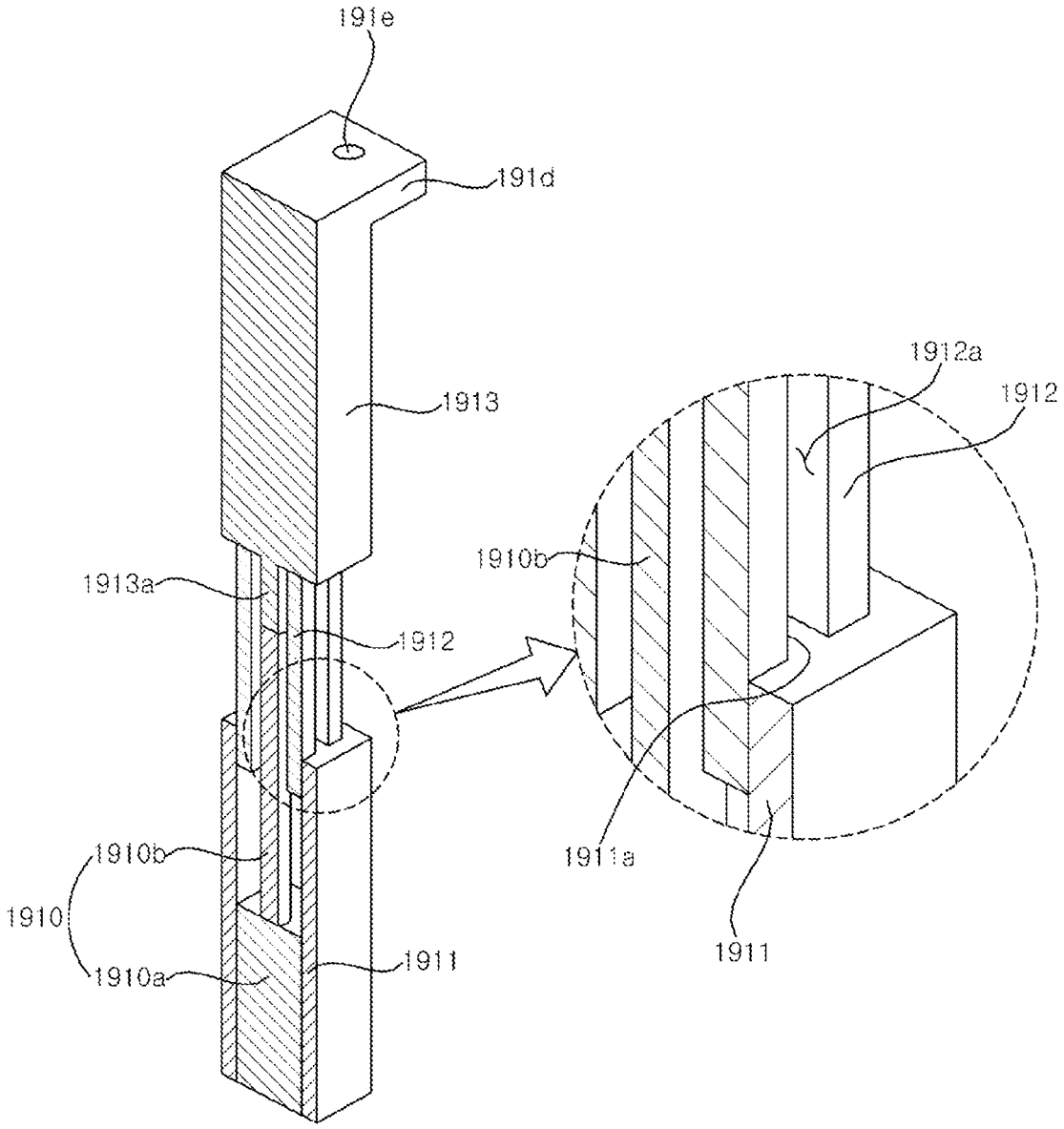
FIGS. 25 to 27 are views for explaining an ion generating device having a stretchable leg according to an embodiment of the present disclosure.
Figure 26:
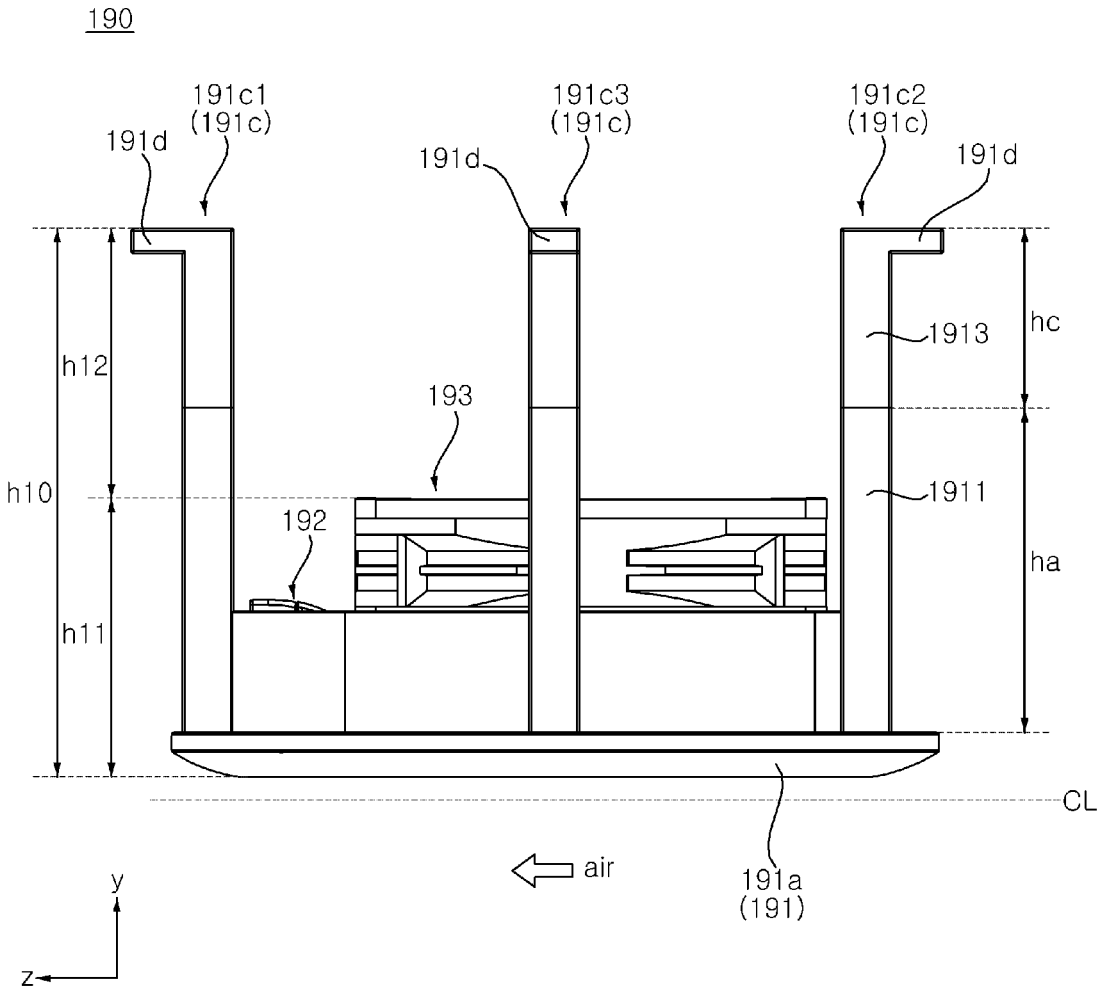
Figure 27:
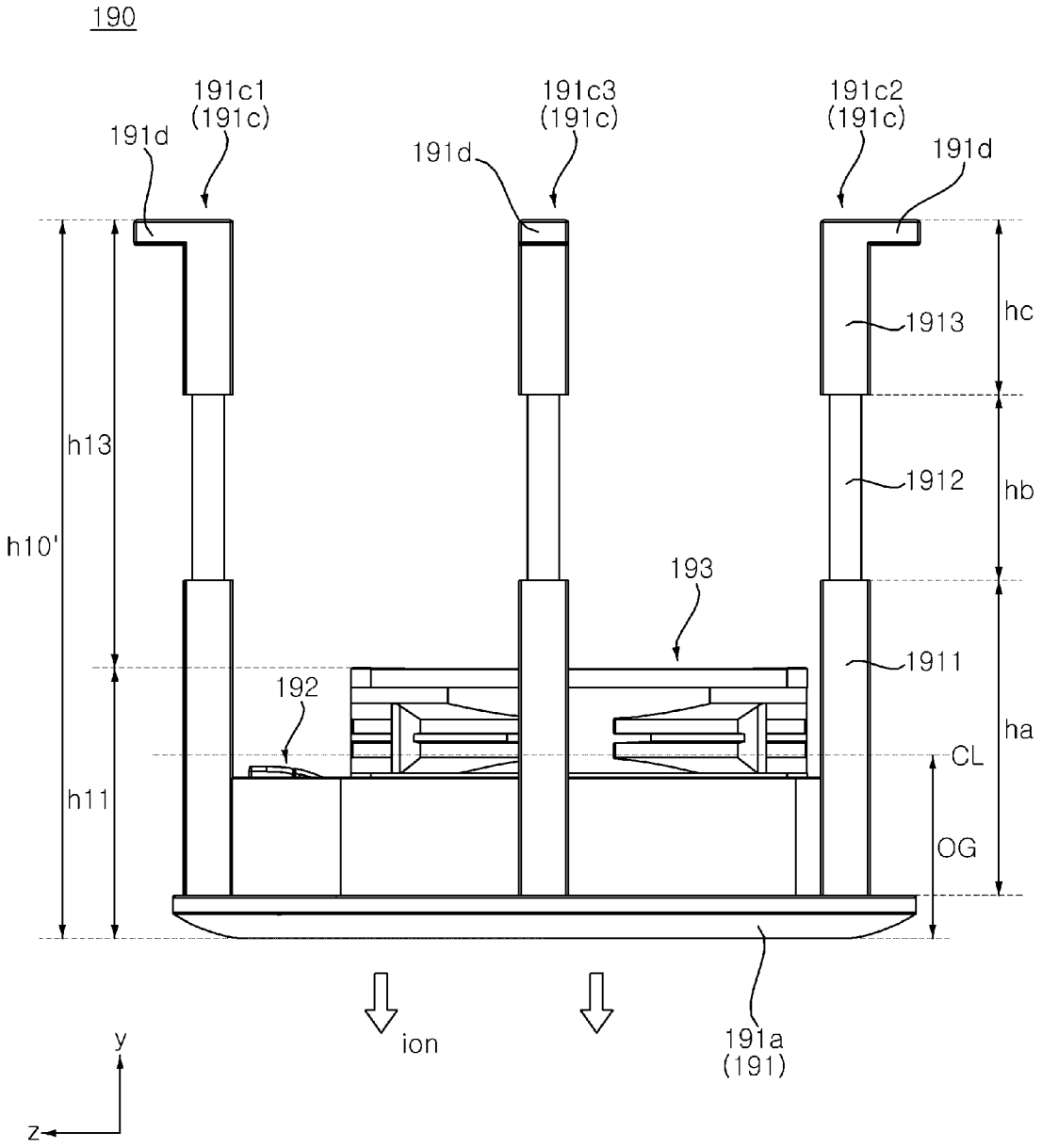

Referring to FIGS. 25 to 27, the leg 191*c* may include a first part 1911, a second part 1912, and a third part 1913. The first part 1911 may be fixed to the upper surface of the base 191*a* (see FIG. 4). The third part 1913 may include a foot 191*d* (see FIG. 4). The second part 1912 may be located between the first part 1911 and the third part 1913.

The first part 1911 may extend in a vertical direction. The first part 1911 may have a hollow cylinder shape or a hollow square bar shape as a whole. A protrusion 1911*a* may be formed in the inner side of the first part 1911. The protrusion 1911*a* may be located on a symmetrical surface of the first part 1911. Here, one portion and the remaining portion of the first part 1911 may be symmetrical with each other with the symmetrical surface interposed therebetween. For example, the protrusion 1911*a* may include a pair of protrusions spaced apart from each other in the horizontal direction.

The second part 1912 may extend in a vertical direction. The second part 1912 may have a hollow cylinder shape or a hollow square bar shape as a whole. The diameter or width of the second part 1912 may be smaller than the diameter or width of the first part 1911. The lower end of the second part 1912 may be inserted into the first part 1911. A guide groove 1912*a* may be formed outside the second part 1912, and may be formed to be elongated in a vertical direction. The guide groove 1912*a* may be located on a symmetrical surface of the second part 1912. Here, one portion and the remaining portion of the second part 1912 may be symmetrical with each other with the symmetrical surface interposed therebetween. For example, the guide groove 1912*a* may include a pair of guide grooves spaced apart from each other in the horizontal direction.

In addition, the protrusion 1911*a* may be vertically movably inserted into the guide groove 1912*a*. That is, the first part 1911 and the second part 1912 may be slide-coupled. The lower end of the guide groove 1912*a* may be blocked. The downward movement of the first part 1911 and the protrusion 1911*a* may be restricted by the lower end of the guide groove 1912*a*. The lower end of the guide groove 1912*a* may be referred to as a lower stopper.

The third part 1913 may extend in a vertical direction. The third part 1913 may have a solid cylinder shape or a solid square bar shape as a whole. A diameter or a width of the third part 1913 may be greater than a diameter or a width of the second part 1912. For example, the diameter or width of the third part 1913 may be substantially the same as the diameter or width of the first part 1911. The lower end of the third part 1913 may contact the upper end of the second part 1912. For example, the third part 1913 may be formed as one body with the second part 1912. The upward movement of the first part 1911 and the protrusion 1911*a* may be restricted by the lower end of the third part 1913. The lower end of the third part 1913 may be referred to as an upper stopper.

In addition, a fixing portion 1913*a* may protrude from the lower end of the third part 1913 toward the inside of the second part 1912.

A linear actuator 1910 may be located inside the first part 1911 and the second part 1912. The linear actuator 1910 may include a linear motor 1910*a* and a rod 1910*b*.

The linear motor 1910*a* may be located closer to the lower end of the first part 1911 than the upper end. The linear motor 1910*a* may be fixed to the inner side of the first part 1911.

The rod 1910*b* may extend upward from the linear motor 1910*a* and may be fixed to the fixing portion 1913*a*. The rod 1910*b* may be vertically moved by the linear motor 1910*a*.

Accordingly, when the linear motor 1910*a* is operated, the first part 1911 may ascend or descend along the second part 1912. In other words, in the vertical direction, the leg 1911 may be compressed or expanded. The leg 191*c* may be referred to as an extendable leg or a stackable leg.

Referring to FIG. 26, for example, in a first state of the ion generating device 190, the first part 1911 of the leg 191*c* may contact the third part 1913. That is, the second part 1912 (see FIG. 25) of the leg 191*c* may be hidden inside the first part 1911. The height of the leg 191*c* may be equal to the sum of the height ha of the first part 1911 and the height hc of the third part 1913.

In this case, the lower end of the ion generating device 190 may be located in the upper side of the reference line CL. Alternatively, the lower end of the ion generating device 190 may be located parallel to or slightly below the reference line CL. Here, the reference line CL may be a virtual line that passes through the upper end of the first portion 13*a* of the recovery wheel 13 and extends in the horizontal direction (see FIGS. 20 and 21).

Referring to FIG. 27, for example, in a second state of the ion generating device 190, the first part 1911 of the leg 191*c* may be spaced apart from the third part 1913. That is, the second part 1912 of the leg 191*c* may be exposed between the first part 1911 and the third part 1913. The height of the leg 191*c* may be equal to the sum of the height ha of the first part 1911, the height hc of the third part 1913, and the height hb of the exposed portion of the second part 1912.

In this case, the lower end of the ion generating device 190 may be located in the lower side of the reference line CL (see OG). In addition, the distance between the upper end of the fan 193 and the foot 191*d* may be increased (see h13).

Figure 28:
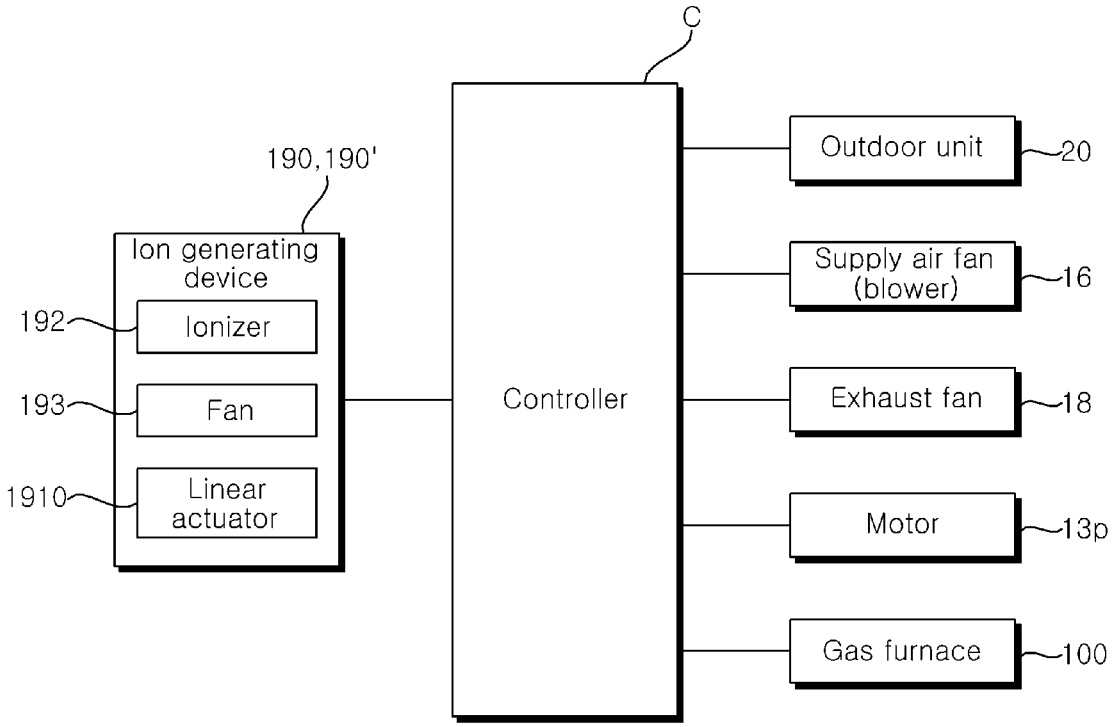
FIGS. 28 and 29 are a control configuration diagram of an air conditioner and a flowchart of control method according to an embodiment of the present disclosure.

Referring to FIG. 28, the controller C of the air conditioner may be electrically connected to the ion generating device 190, 190'. The controller C may control the operations of the ionizer 192, the fan 193, and the linear actuator 1910 of the ion generating device 190, 190'.

Figure 29:
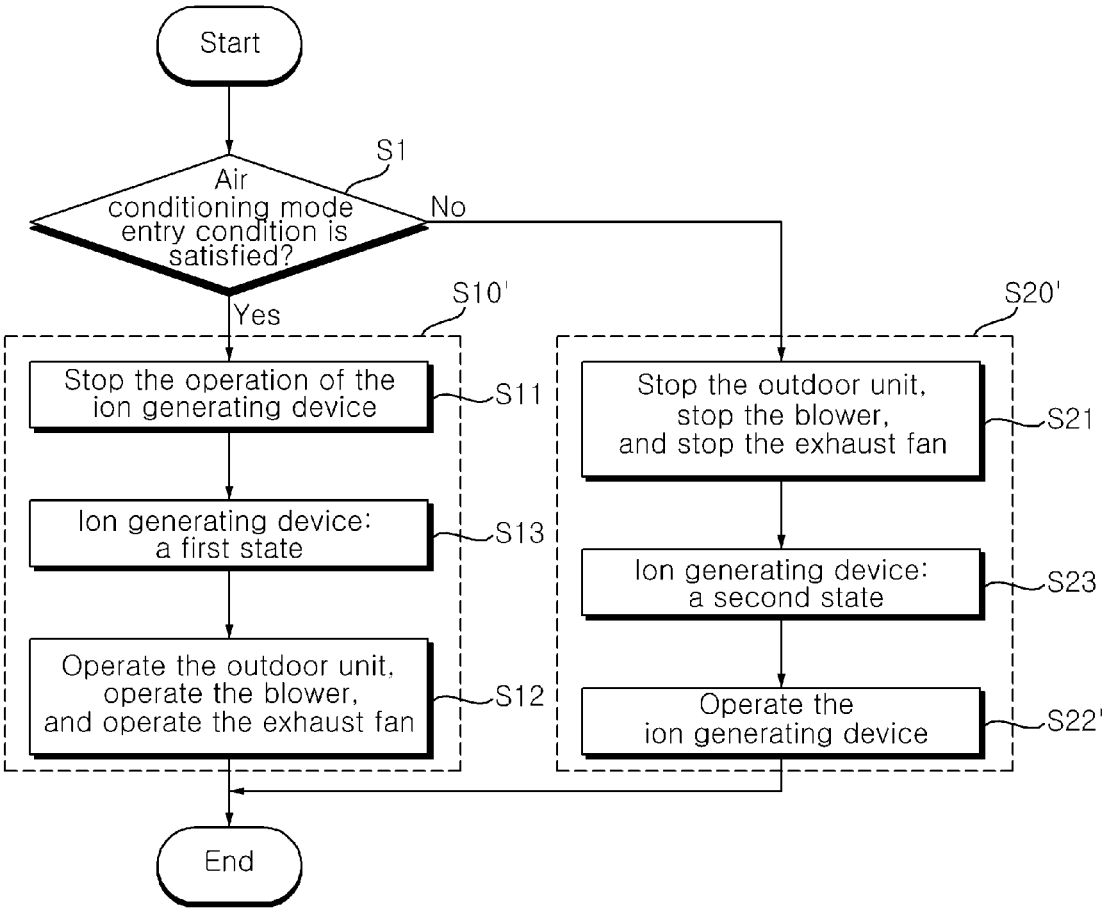

Referring to FIGS. 28 and 29, the controller C may determine whether the air conditioning mode entry condition is satisfied (S1). For example, the air conditioning mode entry condition may be satisfied according to a user's desire. For another example, the air conditioning mode entry condition may be satisfied if a difference between a desired indoor temperature input to the indoor thermostat and a current indoor temperature detected by the thermocouple of the thermostat exceeds a reference range.

When the air conditioning mode entry condition is satisfied (S1: Yes), the controller C may perform the air conditioning operation through the air conditioner 1 (see FIG. 1) (S10'). Specifically, the controller C may stop the operation of the ion generating device 190, 190'(S11), and change the ion generating device 190, 190' to the first state (see FIG. 26) (513). In addition, the controller C may operate the outdoor unit 20, the blower 16, and the exhaust fan 18 (S12). In addition, if indoor heating is required, the controller C may also operate the gas furnace 100.

Accordingly, the air conditioner 1 may cool and heat the indoor space, or ventilate the indoor space. Here, the first state of the ion generating device 190, 190' may be a state capable of minimizing the flow resistance of the air flowing by the blower 16.

When the air conditioning mode entry condition is not satisfied (S1: No), the controller C may perform a sterilization operation through the air conditioner 1 (see FIG. 1) (S20'). Specifically, the controller C may stop the operations of the outdoor unit 20, the blower 16, and the exhaust fan 18. In addition, when the gas furnace 100 is in operation, the controller C may also stop the operation of the gas furnace 100. Then, the controller C may change the ion generating device 190, 190' to the second state (see FIG. 27) (523), and operate the ion generating device 190, 190' (S22).

Accordingly, the air conditioner 1 can sterilize the inside of the ventilation device 10 (see FIG. 1). Here, the second state of the ion generating device 190, 190' may be a state that can maximize the amount of ions discharged from the ion generating device 190, 190' and secure a high sterilization performance.

The effects of the ion generating device and the air conditioner having the same according to the present disclosure will be described as follows.

According to at least one of the embodiments of the present disclosure, it is possible to provide an air conditioner capable of heating or cooling outdoor air through a heat exchanger and supplying to a room.

According to at least one of the embodiments of the present disclosure, it is possible to provide an ion generating device capable of removing bacteria or microorganisms propagating in the housing of an air conditioner in which a heat exchanger is installed.

According to at least one of the embodiments of the present disclosure, it is possible to provide an ion generating device that can be continuously operated for a long time by applying a high voltage to the discharge electrode, and has components that are detachably assembled so as to achieve easy maintenance, management, and maintenance.

According to at least one of the embodiments of the present disclosure, a fan of ion generating device may provide ions generated by the ion generating device to the entire space to be sterilized.

According to at least one of the embodiments of the present disclosure, it is possible to provide an ion generating device including a fan operated independently of a blower for air conditioning operation.

According to at least one of the embodiments of the present disclosure, since the ion generating device is located outside of the airflow passing through the heat exchanger, it is possible to minimize air flow resistance during air conditioning operation.

According to at least one of the embodiments of the present disclosure, the ion generating device is provided with a variable height through the elastic legs, so that it can have a height that minimizes air flow resistance during the air conditioning operation and can have a height that can maximize the sterilization performance during the sterilization operation.

According to at least one of the embodiments of the present disclosure, it is possible to provide a coupling structure and an optimal installation position of the ventilation device and the ion generating device of an air conditioner capable of maximizing the amount of ions generated by the ion generating device.

According to at least one of the embodiments of the present disclosure, various examples regarding the shape and number of ionizers provided in the ion generating device may be provided.

Any or other embodiments of the present disclosure described above are not mutually exclusive or distinct. Any or other embodiments of the present disclosure described above may be used jointly or combined in each configuration or function.

For example, it means that configuration A described in a specific embodiment and/or drawings may be combined with configuration B described in other embodiments and/or drawings. That is, even if the coupling between the components is not directly described, it means that the coupling is possible except for the case where it is described that the coupling is impossible.

The above detailed description should not be construed as restrictive in all respects and should be considered as illustrative. The scope of the present disclosure should be determined by a reasonable interpretation of the appended claims, and all modifications within the equivalent scope of the present disclosure are included in the scope of the present disclosure.

What is claimed is:

1. An air conditioner, comprising:

a housing;

a blower that causes a flow of air passing through an inner space of the housing;

a heat exchanger located in the inner space of the housing; and an ion generating device that is spaced apart from the heat exchanger and coupled to an inner side of the housing, wherein the ion generating device comprises:

a hollow body;

a fan that is coupled to a first side of the body and causes a flow of air passing through an inside of the body; and an ionizer that is coupled to a second side of the body and generates an ion, wherein the ionizer comprises a case hole that is formed in a portion of the ionizer facing the inside of the body and communicates with the inside of the body, wherein the first side of the body faces the inner side of the housing, wherein the fan is spaced apart from the inner side of the housing in a first direction, wherein the ion generating device further comprises a plurality of legs that extends in the first direction, has a first side coupled to the body, and has a second side coupled to the inner side of the housing, and wherein the plurality of legs is expanded in the first direction, or is compressible in a second direction opposite to the first direction.

2. The air conditioner of claim 1, wherein the ionizer is located between an inner surface and an outer surface of the body, wherein one surface of the ionizer defines a portion of a boundary of the inside of the body, and wherein the case hole is formed on the one surface of the ionizer.

3. The air conditioner of claim 2, wherein the fan is coupled to the body, and wherein the ionizer is horizontally spaced apart from the fan.

4. The air conditioner of claim 3, wherein the body comprises:

a seating portion on which the fan is mounted; and a receiving portion that protrudes from one side of the seating portion to an outer side of the seating portion, and extends along the one side, wherein the receiving portion comprises a slot which is formed from one surface of the receiving portion to an inner side of the receiving portion, and into which the ionizer is inserted, and wherein at least a portion of the one side of the seating portion is located between the ionizer and the inside of the body, and is cut-out.

5. The air conditioner of claim 3, wherein the ionizer further comprises a plurality of ionizers spaced apart from each other along a circumference of the body, and wherein a case hole of each of the plurality of ionizers faces the inside of the body.

6. The air conditioner of claim 5, wherein the plurality of ionizers comprises:

a first ionizer that generates any one of a negative ion and a positive ion; and a second ionizer that faces the first ionizer and generates an ion having a same polarity as the ion of the first ionizer.

7. The air conditioner of claim 5, wherein the plurality of ionizers comprises:

a first ionizer comprising a first discharge electrode that generates a negative ion and a second discharge electrode that generates a positive ion; and a second ionizer comprising a third discharge electrode that generates a negative ion and a fourth discharge electrode that generates a positive ion, wherein the third discharge electrode faces the first discharge electrode, and wherein the fourth discharge electrode faces the second discharge electrode.

8. The air conditioner of claim 1, wherein the housing comprises:

a top part that forms an upper side of the housing, and to which the ion generating device is coupled, and wherein a lower end of the ion generating device is located in an upper side of an upper end of the heat exchanger.

9. The air conditioner of claim 8, wherein the heat exchanger further comprises:

a first heat exchanger; and a second heat exchanger that is located downstream of the first heat exchanger, in a passage of air formed by the fan, and wherein the ion generating device is located between the first heat exchanger and the second heat exchanger.

10. The air conditioner of claim 9, wherein a portion of the top part defines an upper boundary of a space formed between the first heat exchanger and the second heat exchanger, and wherein the ion generating device is disposed in a center of the portion of the top part.

11. The air conditioner of claim 9, wherein the heat exchanger further comprises a third heat exchanger located downstream of the second heat exchanger, in the passage of air formed by the fan, and wherein the ion generating device further comprises:

a first ion generating device located between the first heat exchanger and the second heat exchanger; and a second ion generating device located between the second heat exchanger and the third heat exchanger.

12. The air conditioner of claim 11, wherein a number of ionizers provided in the first ion generating device is equal to or greater than a number of ionizers provided in the second ion generating device.

13. The air conditioner of claim 1, wherein the fan is an axial-flow fan having a rotational shaft that extends parallel to the first direction, wherein an upstream of the fan is located between the fan and the inner side of the housing, and wherein a downstream of the fan is located in the inside of the body.

14. The air conditioner of claim 1, wherein each of the plurality of legs comprises:

a first part that forms the first side of the leg;

a second part that is located between the first side and the second side of the leg; and a third part that forms the second side of the leg, and to which the second part is fixed, wherein the first part is coupled to the second part to be movable in the first direction or the second direction, and wherein a linear actuator is disposed inside of the first part and the second part and linearly moves the first part.

15. The air conditioner of claim 14, further comprising a controller that is electrically connected to the blower and the ion generating device, wherein the controller stops the ion generating device, compresses the leg through the linear actuator, and operates the blower, in an air conditioning mode, and stops the blower, expands the leg through the linear actuator, and operates the ion generating device, in a sterilization mode.

16. The air conditioner of claim 1, wherein one of the blower and the ion generating device is operated while the other is stopped.

17. The air conditioner of claim 1, further comprising an outdoor unit that is connected to the heat exchanger through a refrigerant pipe and has a compressor that compresses the refrigerant, wherein a refrigerant flows through the heat exchanger.

18. An ion generating device, comprising:

a hollow body;

a fan that is coupled to a first side of the body and causes a flow of air passing through an inside of the body;

an ionizer that is coupled to a second side of the body and generates an ion, wherein the ionizer comprises a case hole that is formed in a portion of the ionizer facing the inside of the body and communicates with the inside of the body, and a plurality of legs that extends in a first direction, has a first side coupled to the body, and has a second side coupled to an inner side of a housing, and wherein the plurality of legs is expanded in the first direction, or is compressible in a second direction opposite to the first direction.

* * * * *